US008795012B2

(12) United States Patent
Ooishi et al.

(10) Patent No.: US 8,795,012 B2
(45) Date of Patent: Aug. 5, 2014

(54) OUTBOARD MOTOR TILT MOVEMENT INTERRUPTION DEVICE, OUTBOARD MOTOR, MARINE VESSEL PROPULSION APPARATUS, AND MARINE VESSEL

(75) Inventors: Morihiro Ooishi, Shizuoka (JP); Hirohide Ihara, Shizuoka (JP); Takayuki Moue, Shizuoka (JP)

(73) Assignee: Yamaha Hatsudoki Kabushiki Kaisha, Shizuoka (JP)

( * ) Notice: Subject to any disclaimer, the term of this patent is extended or adjusted under 35 U.S.C. 154(b) by 330 days.

(21) Appl. No.: 13/238,099

(22) Filed: Sep. 21, 2011

(65) Prior Publication Data

US 2012/0077395 A1 Mar. 29, 2012

(30) Foreign Application Priority Data

Sep. 29, 2010 (JP) ..... 2010-219387

(51) Int. Cl.
*B63H 5/125* (2006.01)
*B63H 20/08* (2006.01)

(52) U.S. Cl.
USPC ..... 440/61 G

(58) Field of Classification Search
USPC ..... 440/1, 49, 53, 61 R, 61 T, 61 F, 61 G, 65
See application file for complete search history.

(56) References Cited

U.S. PATENT DOCUMENTS

| | | | | |
|---|---|---|---|---|
| 3,722,455 | A * | 3/1973 | Carpenter | 440/56 |
| 3,999,502 | A * | 12/1976 | Mayer | 440/52 |
| 4,776,819 | A * | 10/1988 | Yamamoto et al. | 440/61 R |
| 5,037,338 | A * | 8/1991 | Anderson et al. | 440/61 R |
| 5,989,085 | A * | 11/1999 | Suzuki | 440/53 |
| 7,699,673 | B2 * | 4/2010 | Kawanishi et al. | 440/1 |

FOREIGN PATENT DOCUMENTS

JP 2003-285796 A 10/2003

* cited by examiner

*Primary Examiner* — Daniel V Venne
(74) *Attorney, Agent, or Firm* — Keating & Bennett, LLP

(57) ABSTRACT

In an outboard motor tilt movement interruption device, when a tilt-up stop condition is established by a presence of an obstacle in a tilt-up movement range of an outboard motor and the obstacle and the outboard motor are equal to or less than a predetermined distance from each other, a circuit arranged to actuate a tilt device is cut off by an ON/OFF switch. On the other hand, when the tilt-up stop condition is not established, the circuit is connected. When the tilt-up stop condition is established during an operation of the ON/OFF switch, the circuit is cut off, and tilt-up of the outboard motor is stopped. Thereafter, when the tilt-up stop condition becomes canceled, the circuit is connected and tilt-up of the outboard motor is restarted.

16 Claims, 23 Drawing Sheets

OUTBOARD MOTOR TILT MOVEMENT INTERRUPTION DEVICE, OUTBOARD MOTOR, MARINE VESSEL PROPULSION APPARATUS, AND MARINE VESSEL

BACKGROUND OF THE INVENTION

1. Field of the Invention

The present invention relates to an outboard motor tilt movement interruption device, an outboard motor, a marine vessel propulsion apparatus, and a marine vessel. The outboard motor tilt movement interruption device is arranged to interrupt a tilt-up movement of the outboard motor by interfering with an operation of a tilt device arranged to tilt up the outboard motor by turning the outboard motor around a tilt shaft in response to an operation of a tilt-up operation switch.

2. Description of the Related Art

A conventional marine vessel is described in Japanese Published Unexamined Patent Application No. 2003-285796. This marine vessel includes a hull, an outboard motor, a bracket device, a PTT device (power trim and tilt device), a PTT switch, and a control device. The outboard motor is attached to the rear portion of a hull via the bracket device. The outboard motor is turnable up and down around a tilt shaft extending in the horizontal direction. When the PTT switch is operated by a marine vessel operator, the control device turns the outboard motor around the tilt shaft by controlling the PTT device.

The PTT device can tilt up the outboard motor from a position at which the outboard motor is substantially vertical to a stop position at which the outboard motor tilts so that the lower portion of the outboard motor is positioned rearward relative to the upper portion of the outboard motor. The control device stores a stop angle A corresponding to the stop position. In the control device, an allowance angle $\alpha$ is set. When the PTT device tilts up the outboard motor, if the tilt angle of the outboard motor exceeds a predetermined angle (stop angle A–allowance angle $\alpha$), the control device stops tilting-up of the outboard motor.

SUMMARY OF THE INVENTION

The inventors of preferred embodiments of the present invention described and claimed in the present application conducted an extensive study and research regarding an outboard motor tilt movement interruption device, an outboard motor, a marine vessel propulsion apparatus, and a marine vessel, such as the one described above, and in doing so, discovered and first recognized new unique challenges and previously unrecognized possibilities for improvements as described in greater detail below.

In detail, a case where an obstacle is present in the tilt-up movement range of the outboard motor is considered. In this case, if the marine vessel operator tilts up the outboard motor without awareness of the presence of the obstacle, the outboard motor may collide with the obstacle. Therefore, it is demanded that the outboard motor is stopped just in front of the obstacle even when the marine vessel operator performs a tilt-up operation when an obstacle is present.

The conventional control device stops tilt-up of the outboard motor when the tilt angle of the outboard motor exceeds a predetermined angle (stop angle A–allowance angle $\alpha$). Accordingly, the tilt angle of the outboard motor is prevented from exceeding the stop angle A. Therefore, by setting the tilt angle of the outboard motor when the outboard motor is positioned just in front of the obstacle to the stop angle A, the outboard motor can be prevented from colliding with the obstacle.

On the other hand, this conventional control device does not tilt up the outboard motor to an angle exceeding the stop angle A. Therefore, even when no obstacle is present in the tilt-up movement range or the obstacle is removed, the outboard motor is not tilted up to an angle exceeding the stop angle A. Specifically, the conventional control device cannot restart a tilt-up movement of the outboard motor after the tilt-up movement is interrupted.

In order to overcome the previously unrecognized and unsolved challenges described above, a preferred embodiment of the present invention provides an outboard motor tilt movement interruption device arranged to interrupt a tilt-up movement of an outboard motor by interfering with an operation of a tilt device arranged to tilt up the outboard motor by turning the outboard motor around a tilt shaft in response to an operation of a tilt-up operation switch. The tilt movement interruption device includes an ON/OFF switch. The ON/OFF switch is disposed in a circuit arranged to actuate the tilt device. The ON/OFF switch is arranged to stop tilt-up of the outboard motor by cutting off the circuit when a tilt-up stop condition is established during the operation of the tilt-up operation switch and restart tilt-up of the outboard motor by connecting the circuit when the tilt-up stop condition is canceled after a stop of tilt-up. The tilt-up stop condition includes a condition in which an obstacle is present in a tilt-up movement range of the outboard motor and the obstacle and the outboard motor are equal to or less than a predetermined distance from each other.

With this arrangement of the present preferred embodiment of the present invention, the outboard motor tilt movement interruption device includes the ON/OFF switch disposed in a circuit arranged to actuate the tilt device. The circuit is opened and closed by the ON/OFF switch. Specifically, when the tilt-up stop condition is established, the circuit is cut off, and when the tilt-up stop condition is not established, the circuit is connected. Therefore, when the outboard motor tilt-up stop condition is established during the operation of the tilt-up operation switch, the circuit is cut off, and tilt-up of the outboard motor is stopped. When the tilt-up stop condition becomes canceled after tilt-up of the outboard motor is stopped according to establishment of the tilt-up stop condition, the circuit is connected, so that tilt-up of the outboard motor is restarted. Therefore, after interrupting the tilt-up movement of the outboard motor, the tilt movement interruption device can restart the movement and tilt up the outboard motor to a larger angle.

In a preferred embodiment, the ON/OFF switch may be connected in series to a transmission circuit including a transmission path of a tilt-up command to be supplied to the tilt device in response to an operation of the tilt-up operation switch.

In a preferred embodiment, the ON/OFF switch may be connected in series to a power supply circuit including a power supply path of the tilt device.

In a preferred embodiment, the ON/OFF switch may include a first switch and a second switch. The first switch may be arranged to be turned off when the obstacle is present in the tilt-up movement range of the outboard motor, and be turned on when no obstacle is in the tilt-up movement range. The second switch may be connected in parallel to the first switch, and may be arranged to be turned off when a tilt position of the outboard motor is between a tilt upper limit position and a tilt interruption position set within the tilt-up movement range, and be turned on when the tilt position does not reach the tilt interruption position.

In a preferred embodiment, the tilt movement interruption device may further include a proximity sensor arranged to detect whether the outboard motor and the obstacle are equal to or less than a predetermined distance from each other. In this case, the ON/OFF switch may be arranged to be turned off when the proximity sensor detects that the outboard motor and the obstacle are equal to or less than the predetermined distance from each other. Further, the ON/OFF switch may be arranged to be turned on unless the proximity sensor detects that the outboard motor and an obstacle are equal to or less than the predetermined distance or less from each other.

Another preferred embodiment of the present invention provides a marine vessel propulsion apparatus including an outboard motor, a tilt-up operation switch, and the outboard motor tilt movement interruption device. The outboard motor includes a tilt device arranged to tilt up the outboard motor by turning the outboard motor around a tilt shaft. The tilt-up operation switch is arranged to be operated by an operator to actuate the tilt device to tilt up the outboard motor by turning the outboard motor around the tilt shaft.

Still another preferred embodiment of the present invention provides a marine vessel including a hull and the marine vessel propulsion apparatus provided on the hull.

Still another preferred embodiment of the present invention provides an outboard motor including a tilt device and a first control unit. The tilt device is arranged to tilt up the outboard motor by turning the outboard motor around a tilt shaft according to an operation of a tilt-up operation switch. The first control unit is programmed to output a tilt-up execution signal to actuate the tilt device and tilt up the outboard motor when the tilt-up operation switch is operated and the tilt-up stop condition is not established. Further, the first control unit is programmed not to output the tilt-up execution signal even when the tilt-up operation switch is operated if the tilt-up stop condition is established. Further, the first control unit is programmed to stop output of the tilt-up execution signal when the tilt-up stop condition is established during the operation of the tilt-up operation switch, and restart the output of the tilt-up execution signal when the tilt-up stop condition becomes canceled after the output of the tilt-up execution signal is stopped.

In a preferred embodiment, the tilt-up stop condition may include a condition that an obstacle is present in the tilt-up movement range of the outboard motor and the obstacle and the outboard motor are equal to or less than a predetermined distance from each other.

In a preferred embodiment, the outboard motor may further include a first switch and a second switch connected to the first control unit. The first switch may be arranged to turn into a first state when an obstacle is present in the tilt-up movement range of the outboard motor, and turn into a second state when no obstacle is present in the tilt-up movement range. The second switch may be arranged to turn into a third state when the tilt position of the outboard motor is between the tilt upper limit position and the tilt interruption position set within the tilt-up movement range, and turn into a fourth state when the tilt position does not reach the tilt interruption position. In this case, the tilt-up stop condition may include a condition that the first switch is in the first state and the second switch is in the third state.

In a preferred embodiment, the outboard motor may further include a proximity sensor that is connected to the first control unit. The proximity sensor is arranged to detect whether the outboard motor and an obstacle are equal to or less than a predetermined distance from each other. In this case, the tilt-up stop condition may include a condition that the proximity sensor has detected that the outboard motor and the obstacle are equal to or less than the predetermined distance from each other.

Still another preferred embodiment of the present invention provides a marine vessel propulsion apparatus including the outboard motor, and a tilt-up operation switch arranged to be operated by an operator to tilt up the outboard motor by turning the outboard motor around the tilt shaft by actuating the tilt device.

Still another preferred embodiment of the present invention provides a marine vessel including a hull and the marine vessel propulsion apparatus provided on the hull.

Still another preferred embodiment of the present invention provides a marine vessel propulsion apparatus including an outboard motor, a tilt-up operation switch, and a second control unit. The outboard motor includes a tilt device arranged to tilt up the outboard motor by turning the outboard motor around a tilt shaft. The tilt-up operation switch is arranged to be operated by an operator to tilt up the outboard motor by turning the outboard motor around the tilt shaft by actuating the tilt device. The second control unit is programmed to output a tilt-up execution signal to actuate the tilt device and tilt up the outboard motor when the tilt-up operation switch is operated and the tilt-up stop condition is not established. Further, the second control unit is programmed not to output the tilt-up execution signal to the outboard motor even when the tilt-up operation switch is operated if the tilt-up stop condition is established. Further, the second control unit is programmed to stop output of the tilt-up execution signal when the tilt-up stop condition is established during the operation of the tilt-up operation switch, and restart the output of the tilt-up execution signal when the tilt-up stop condition becomes canceled after the output of the tilt-up execution signal is stopped.

In a preferred embodiment, the marine vessel propulsion apparatus may further include an output adjusting operation unit arranged to be operated by an operator to adjust the output of the outboard motor. The second control unit may be installed inside the output adjusting operation unit.

In a preferred embodiment, the tilt-up stop condition may include a condition that an obstacle is present in a tilt-up movement range of the outboard motor and the obstacle and the outboard motor are equal to or less than a predetermined distance from each other.

In a preferred embodiment, the marine vessel propulsion apparatus may further include a first switch and a second switch connected to the second control unit. The first switch may be arranged to turn into a first state when an obstacle is present in the tilt-up movement range of the outboard motor, and turn into a second state when no obstacle is present in the tilt-up movement range. The second switch may be arranged to turn into a third state when a tilt position of the outboard motor is between the tilt upper limit position and the tilt interruption position set within the tilt-up movement range, and turn into a fourth state when the tilt position does not reach the tilt interruption position. In this case, the tilt-up stop condition may include a condition that the first switch is in the first state and the second switch is in the third state.

In a preferred embodiment, the marine vessel propulsion apparatus may further include a proximity sensor that is connected to the second control unit. The proximity sensor is arranged to detect whether the outboard motor and an obstacle are equal to or less than a predetermined distance from each other. In this case, the tilt-up stop condition may include a condition that the proximity sensor has detected that the outboard motor and an obstacle are equal to or less than the predetermined distance from each other.

Still another preferred embodiment of the present invention provides a marine vessel including a hull and the marine vessel propulsion apparatus provided on the hull.

The above and other elements, features, steps, characteristics and advantages of the present invention will become more apparent from the following detailed description of the preferred embodiments with reference to the attached drawings.

DETAILED DESCRIPTION OF THE PREFERRED EMBODIMENTS

First Preferred Embodiment

Figure 1:
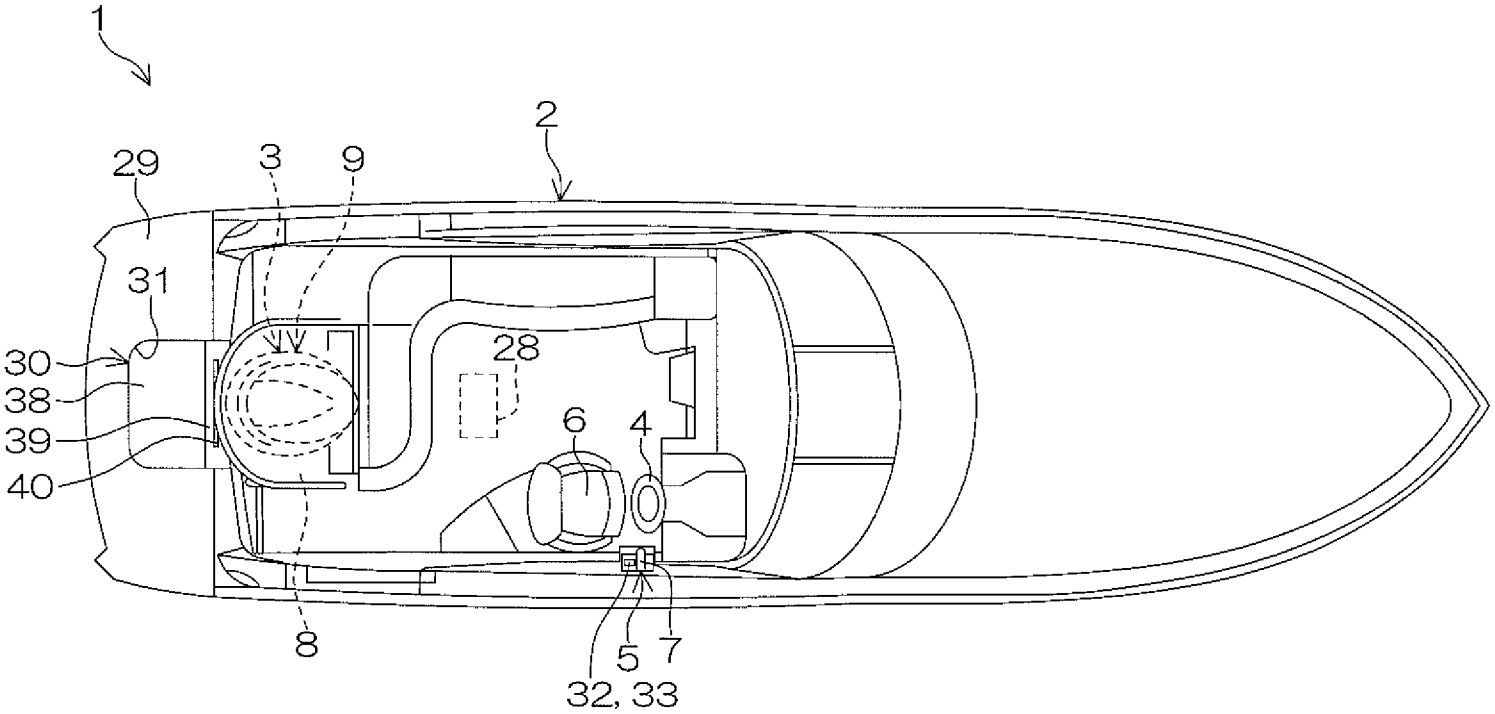
FIG. 1 is an illustrated plan view of a marine vessel according to a first preferred embodiment of the present invention.
Figure 2:
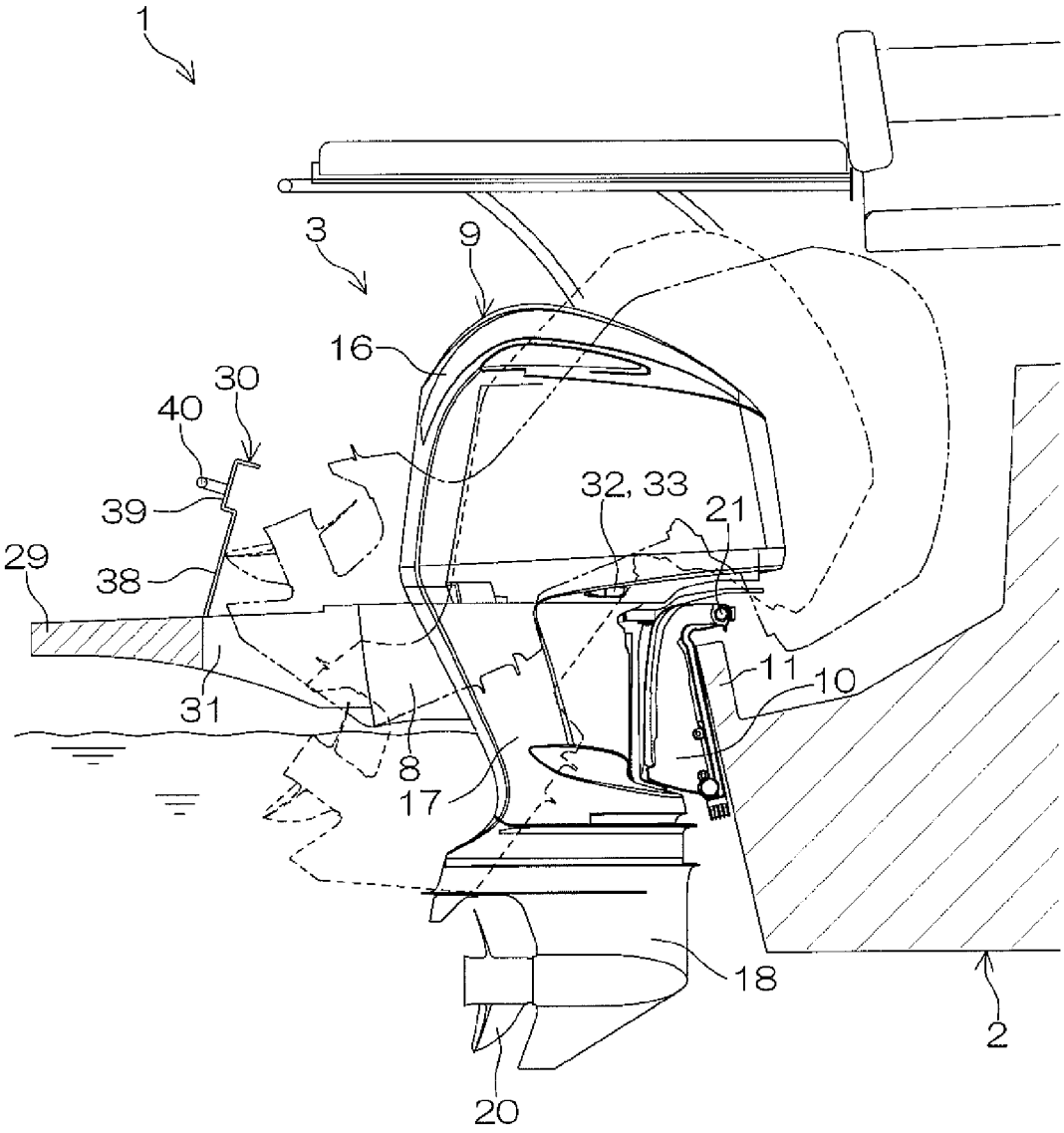
FIG. 2 is a partial sectional view of a rear portion of the marine vessel according to the first preferred embodiment of the present invention.
Figure 3:
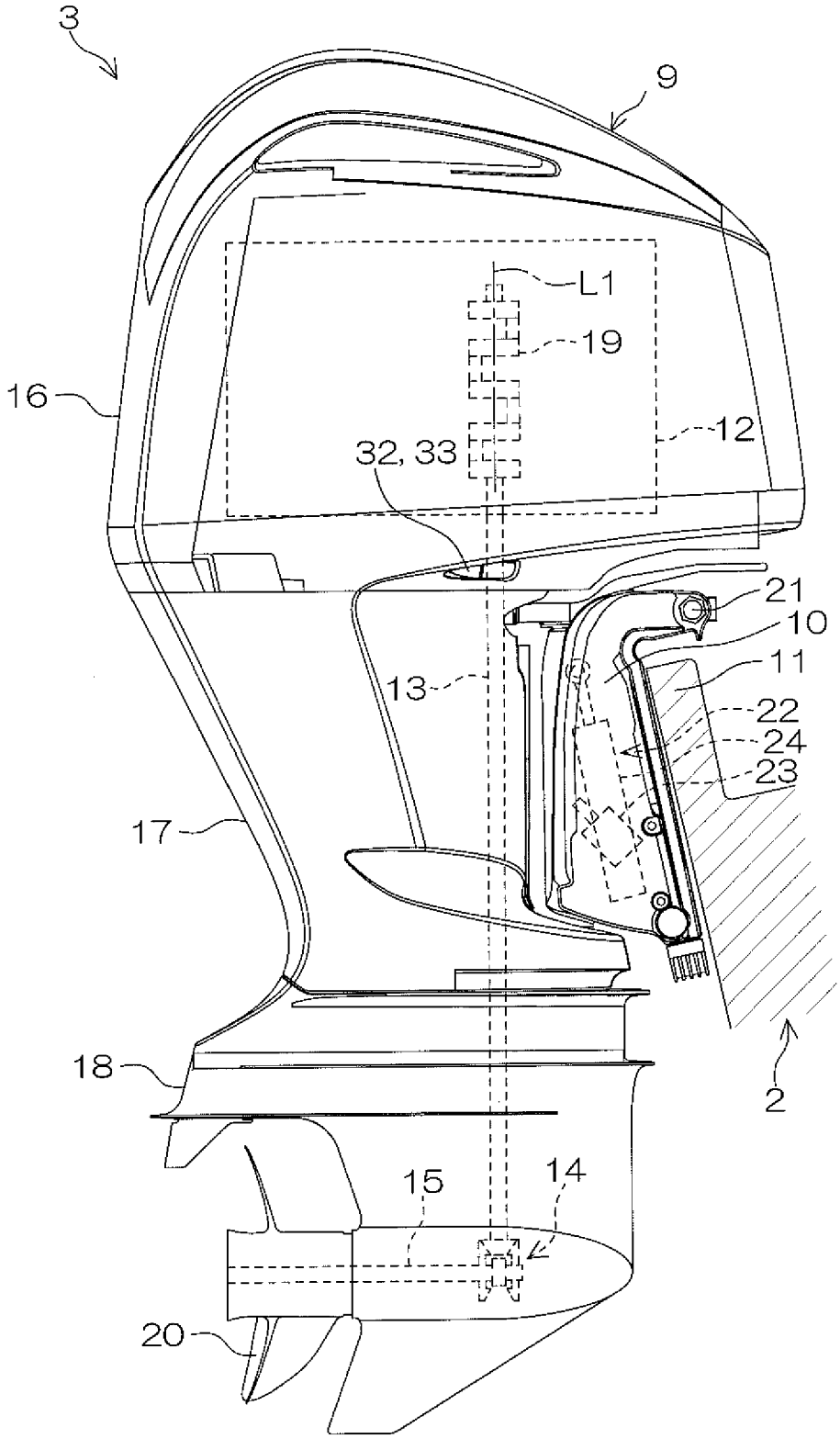
FIG. 3 is a side view of a marine vessel propulsion apparatus according to the first preferred embodiment of the present invention.
Figure 4:
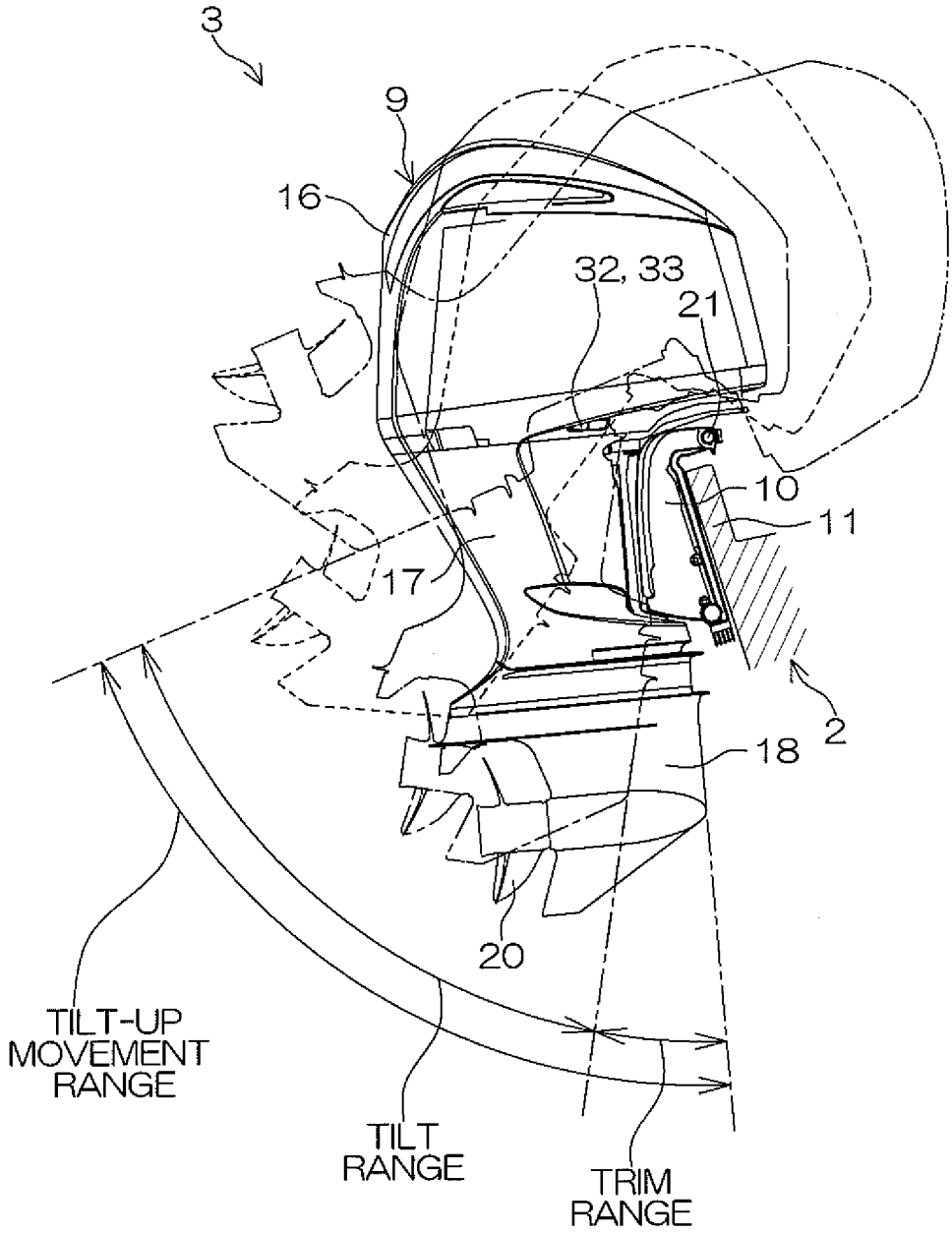
FIG. 4 is a side view of the marine vessel propulsion apparatus according to the first preferred embodiment of the present invention.
Figure 5:
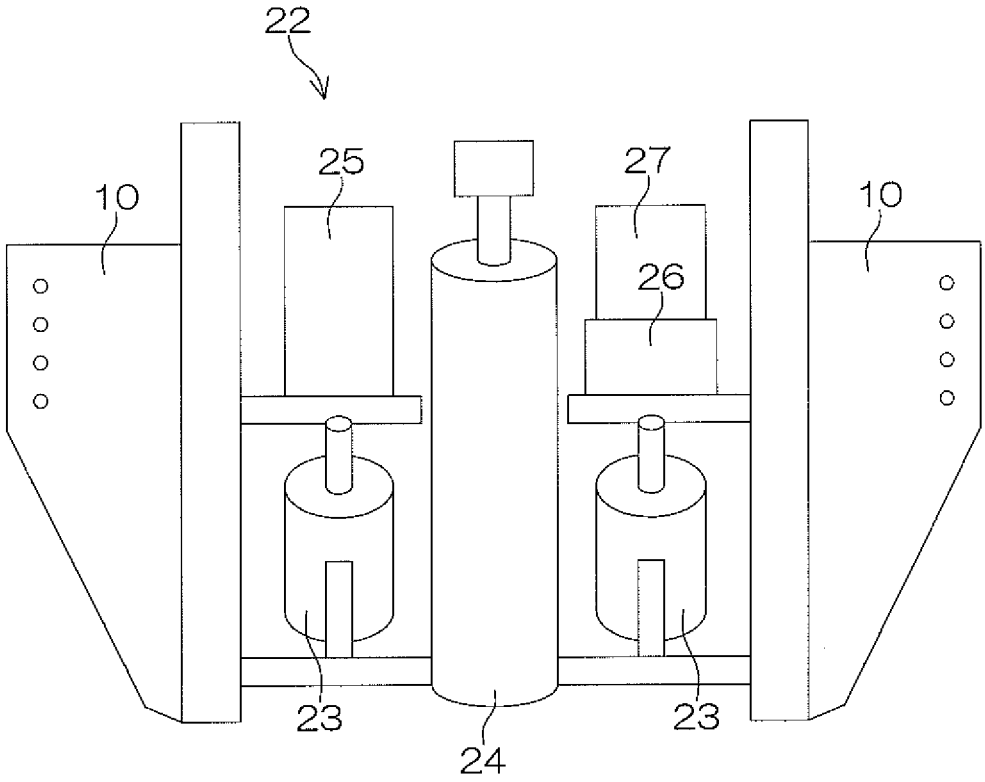
FIG. 5 is an illustrated back view of a PPT device (power trim and tilt device) according to the first preferred embodiment of the present invention.

FIG. 1 is an illustrated plan view of a marine vessel 1 according to a first preferred embodiment of the present invention. FIG. 2 is a partial sectional view of a rear portion of the marine vessel 1 according to the first preferred embodiment of the present invention. FIG. 3 and FIG. 4 are side views of a marine vessel propulsion apparatus 3 according to the first preferred embodiment of the present invention. FIG. 5 is an illustrated back view of a power trim and tilt device 22 according to the first preferred embodiment of the present invention. In FIG. 4, a state in which the outboard motor 9 is at a full trim-in position is shown by the solid line, and a state in which the outboard motor 9 is at a full trim-out position is shown by the alternate long and short dashed lines. Further, in FIG. 4, a state in which the outboard motor 9 is at a full tilt-up position is shown by the alternate long and two short dashed lines, and a state in which the outboard motor 9 is at the tilt interruption position is shown by the dashed lines. Similarly, in FIG. 2, the state in which the outboard motor 9 is at the full tilt-up position is shown by the alternate long and two short dashed lines, and a state in which the outboard motor 9 is at the tilt interruption position is shown by the dashed lines.

As shown in FIG. 1, the marine vessel 1 includes a hull 2, a marine vessel propulsion apparatus 3, a handle 4, and a remote controller 5. The handle 4 and the remote controller 5 are disposed near a marine vessel operator's seat 6. When the handle 4 is operated by a marine vessel operator, the marine vessel 1 is steered. When a forward/backward operation lever 7 provided on the remote controller 5 is operated by a marine vessel operator, the marine vessel 1 is propelled in the forward or backward running direction. Further, when the forward/backward operation lever 7 is operated by the marine vessel operator, switching between forward running and backward running of the marine vessel 1 is performed. The marine vessel propulsion apparatus 3 generates a propulsive force that propels the marine vessel 1. An output (propulsive force) of the marine vessel propulsion apparatus 3 is adjusted by an operation of the forward/backward operation lever 7. The marine vessel propulsion apparatus 3 is attached to a rear portion of the hull 2. The hull 2 has a recessed portion 8 recessed forward from the rear end of the hull 2. The marine vessel propulsion apparatus 3 is housed in this recessed portion 8.

As shown in FIG. 3, the marine vessel propulsion apparatus 3 includes an outboard motor 9 and a bracket 10. The outboard motor 9 is attached to a transom 11 provided on the rear portion of the hull 2 via a bracket 10. The outboard motor 9 includes an engine 12, a drive shaft 13, a forward/backward switching mechanism 14, and a propeller shaft 15. The outboard motor 9 further includes an engine cover 16, an upper case 17, and a lower case 18. The engine 12 is covered by the engine cover 16. The engine 12 includes a crankshaft 19 extending up and down. The drive shaft 13 is joined to the lower end portion of the crankshaft 19. The drive shaft 13 extends up and down inside the upper case 17 and the lower case 18. The drive shaft 13 is joined to the propeller shaft 15 via the forward/backward switching mechanism 14 inside the lower case 18. The propeller shaft 15 extends in the front-rear direction inside the lower case 18. The rear end portion of the propeller shaft 15 projects rearward from the lower case 18. The propeller 20 is joined to the rear end portion of the propeller shaft 15.

The forward/backward switching mechanism 14 is set to any of a forward propelling state, a backward propelling state, and a neutral state according to an operation of the forward/backward operation lever 7 by a marine vessel operator. In the state in which the forward/backward switching mechanism 14 is set to the forward propelling state, the rotation of the engine 12 (rotation of the crankshaft 19) is transmitted to the propeller shaft 15 without reversing, and the propeller 20 rotates in the forward propelling rotational direction. Accordingly, a propulsive force that propels the marine vessel 1 in the forward direction is generated. On the other hand, in the state in which the forward/backward switching mechanism 14 is set to the backward propelling state, the rotation of the engine 12 is reversed and transmitted to the propeller shaft 15, and the propeller 20 rotates in the backward propelling rotational direction opposite to the forward propelling rotational direction. Accordingly, a propulsive force that propels the marine vessel 1 in the backward direction is generated. In the state in which the forward/backward switching mechanism 14 is set to the neutral state, mechanical joining between the drive shaft 13 and the propeller shaft 15 is cut off, and transmission of the rotation to the propeller 20 is blocked.

As shown in FIG. 3, the marine vessel propulsion apparatus 3 further includes a tilt shaft 21, a power trim and tilt device 22 (hereinafter, referred to as "PIT device 22"). The tilt shaft 21 extends in the horizontal direction ahead of the outboard motor 9. As shown in FIG. 4, the outboard motor 9 is turnable around the tilt shaft 21 with respect to the hull 2. The PTT device 22 tilts the outboard motor 9 with respect to the hull 2 by turning the outboard motor 9 around the tilt shaft 21 between a full trim-in position (the position shown by the solid line in FIG. 4), and a full tilt-up position (the position shown by the alternate long and two short dashed lines in FIG. 4). A tilting angle of the outboard motor 9 when the rotational axis L1 (refer to FIG. 3) of the crankshaft 19 extends along the up-down direction is defined as zero, and a direction in which the outboard motor 9 turns around the tilt shaft 21 so that the upper end of the rotational axis L1 is positioned forward relative to the lower end of the rotation axis L1 is defined as a positive direction. The full trim-in position is a position at which the tilting angle of the outboard motor 9 is smallest, and the full tilt-up position is a position at which the tilting angle of the outboard motor 9 is largest. As shown in FIG. 4, the tilt-up movement range includes a range from the full trim-in position to the full tilt-up position. Specifically, the tilt-up movement range is the whole space that the outboard motor 9 passes when the outboard motor 9 moves from the full trim-in position to the full tilt-up position. The PTT device 22 can stop the outboard motor 9 at an arbitrary position within the tilt-up movement range.

As shown in FIG. 5, the PTT device 22 includes two trim cylinders 23 disposed parallel or substantially parallel to each other at an interval in the right-left direction, and a tilt cylinder 24 disposed between the two trim cylinders 23. The trim cylinders 23 and the tilt cylinder 24 are, for example, hydraulic cylinders. The PTT device 22 includes a tank 25 storing hydraulic oil, an oil pump 26 that supplies the hydraulic oil stored in the tank 25 to the trim cylinders 23 and the tilt cylinder 24, and an electric motor 27 that drives the oil pump 26. As shown in FIG. 1, the marine vessel 1 includes a battery 28 disposed inside the hull 2. The marine vessel propulsion apparatus 3 is connected to the battery 28. The electric motor 27 is driven by electric power of the battery 28. According to driving of the electric motor 27, the trim cylinders 23 and the tilt cylinder 24 are supplied with hydraulic oil, and the rods of the trim cylinders 23 and the tilt cylinder 24 advance and retract.

The trim cylinders 23 turn the outboard motor 9 around the tilt shaft 21 between the full trim-in position and a full trim-out position (the position shown by the alternate long and short dashed lines in FIG. 4) provided between the full trim-in position and the full tilt-up position. The tilt cylinder 24 turns the outboard motor 9 around the tilt shaft 21 between the full trim-in position and the full tilt-up position. As shown in FIG. 4, the range between the full trim-in position and the full trim-out position is a "trim range," and a range in which the tilting angle of the outboard motor 9 is larger than a full trim-out angle (a tilting angle of the outboard motor 9 corresponding to the full trim-out position) is a "tilt range." In the trim range, the outboard motor 9 is supported by the trim cylinders 23 and the tilt cylinder 24. When the outboard motor 9 moves from the trim range to the tilt range, the rods of the trim cylinders 23 separate from the outboard motor 9. Therefore, in the tilt range, the outboard motor 9 is supported by the tilt cylinder 24.

As shown in FIG. 1 and FIG. 2, the marine vessel 1 includes a platform 29 and a hatch 30. The platform 29 extends rearward along a horizontal plane from the rear portion of the hull 2. The outboard motor 9 is surrounded by the hull 2 and the platform 29. The platform 29 is a member that has a thickness (length in the up-down direction) that is thinner than that of the hull 2 and is substantially bilaterally symmetric. The upper surface of the platform 29 has a rectangular shape with a width (length in the right-left direction) that is substantially equal to that of the rear portion of the hull 2. The platform 29 is attached to the hull 2 so that the upper surface of the platform 29 is positioned higher than the water surface around the hull 2. The platform 29 includes a notch 31 having a rectangular shape in a plan view recessed rearward from the front end of the platform 29. The notch 31 penetrates through the platform 29 in the up-down direction. The notch 31 is disposed at the rear of the recessed portion 8. The notch 31 is connected to the recessed portion 8. The hatch 30 is attached to the platform 29 so as to turn up and down around the rear end portion of the hatch 30. The hatch 30 is movable between a closed position (the position shown in FIG. 1) at which the notch 31 is closed by the hatch 30 and an opened position (the position shown in FIG. 2) at which the front end portion of the hatch 30 moves to a position above the platform 29 and the notch 31 is opened.

As shown in FIG. 2, a portion of the tilt-up movement range is provided inside the notch 31. In the state in which the hatch 30 is closed (the state in which the hatch 30 is at the closed position), a portion of the hatch 30 is positioned within the tilt-up movement range. On the other hand, in the state in which the hatch 30 is opened (the state in which the hatch 30 is disposed at the opened position), the hatch 30 is positioned out of the tilt-up movement range. For example, when the outboard motor 9 is tilted up from the trim range to the full tilt-up position in the state in which the hatch 30 is opened, a portion of the lower case 18 and the propeller 20 move to a position above the platform 29 through the notch 31. In the state in which the outboard motor 9 is at the full tilt-up position, the outboard motor 9 enters the inside of the notch 31.

As shown in FIG. 1, the marine vessel propulsion apparatus 3 includes a pair of an up switch 32 and a down switch 33 provided on the remote controller 5. As shown in FIG. 2, the outboard motor 9 includes a pair of an up switch 32 and a down switch 33 provided on a side surface of the engine cover 16. The up switch 32 and the down switch 33 are switches arranged to turn the outboard motor 9 around the tilt shaft 21. While the up switch 32 is operated by a marine vessel operator, the PTT device 22 turns the outboard motor 9 around the tilt shaft 21 toward the full tilt-up position. On the other hand, while the down switch 33 is operated by a marine vessel operator, the PTT device 22 turns the outboard motor 9 around the tilt shaft 21 toward the full trim-in position.

Figure 12:
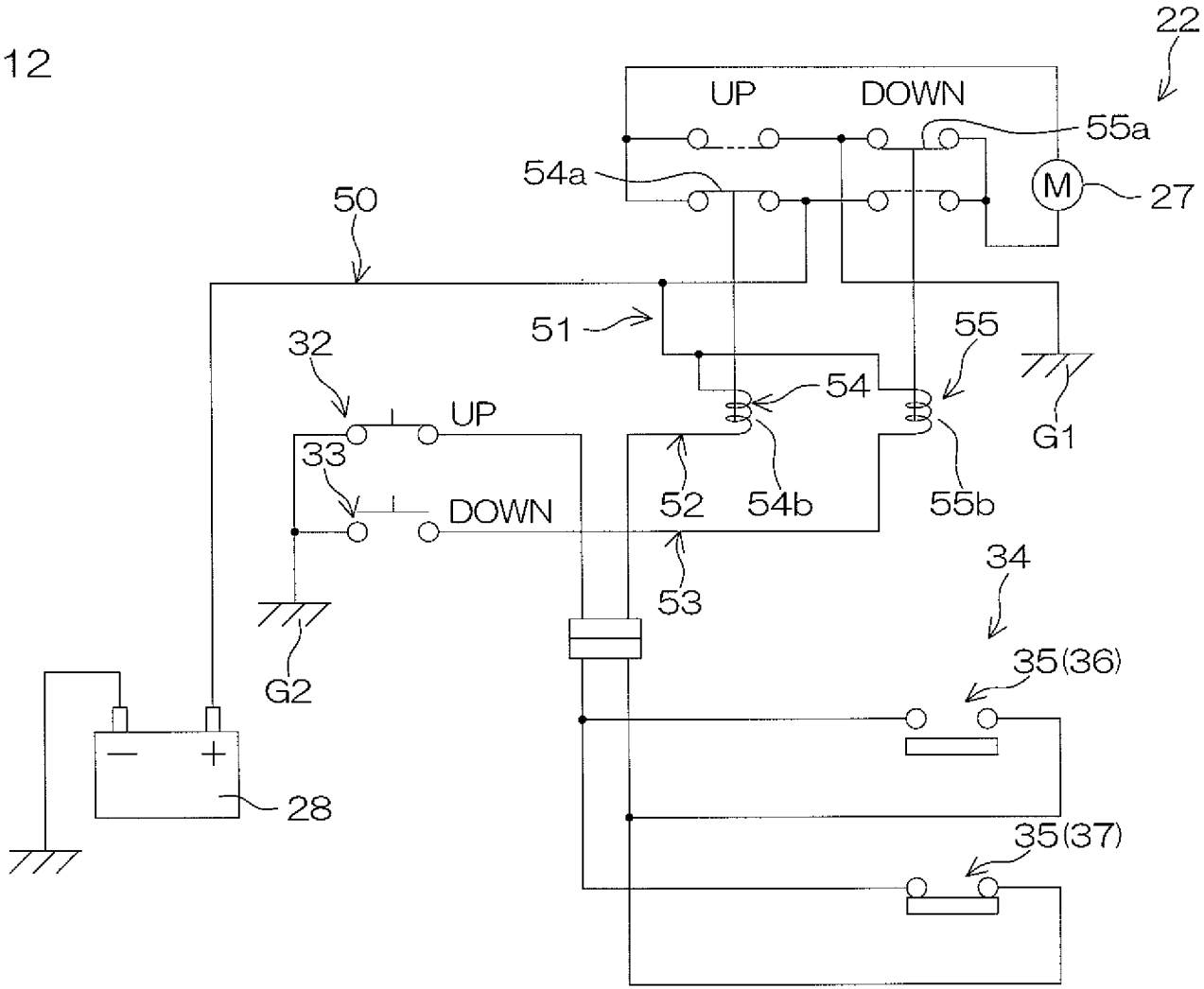
FIG. 12 is a circuit diagram of a circuit arranged to actuate the PTT device according to the first preferred embodiment of the present invention.

The marine vessel propulsion apparatus 3 includes a tilt movement interruption device 34 (refer to FIG. 12). As described later, the tilt movement interruption device 34 is arranged to interfere with the operation of the PTT Device 22 to interrupt the tilt-up movement of the outboard motor 9 when the tilt-up stop condition is established during the operation of the up switch 32. The tilt movement interruption device 34 includes an ON/OFF switch 35 (refer to FIG. 12) that opens and closes a circuit arranged to actuate the PTT device 22. The ON/OFF switch 35 includes a first switch 36 and a second switch 37 (refer to FIG. 12) disposed in the circuit arranged to actuate the PTT device 22. Hereinafter, the first switch 36, the second switch 37, and an arrangement relating thereto will be described.

Figure 6:
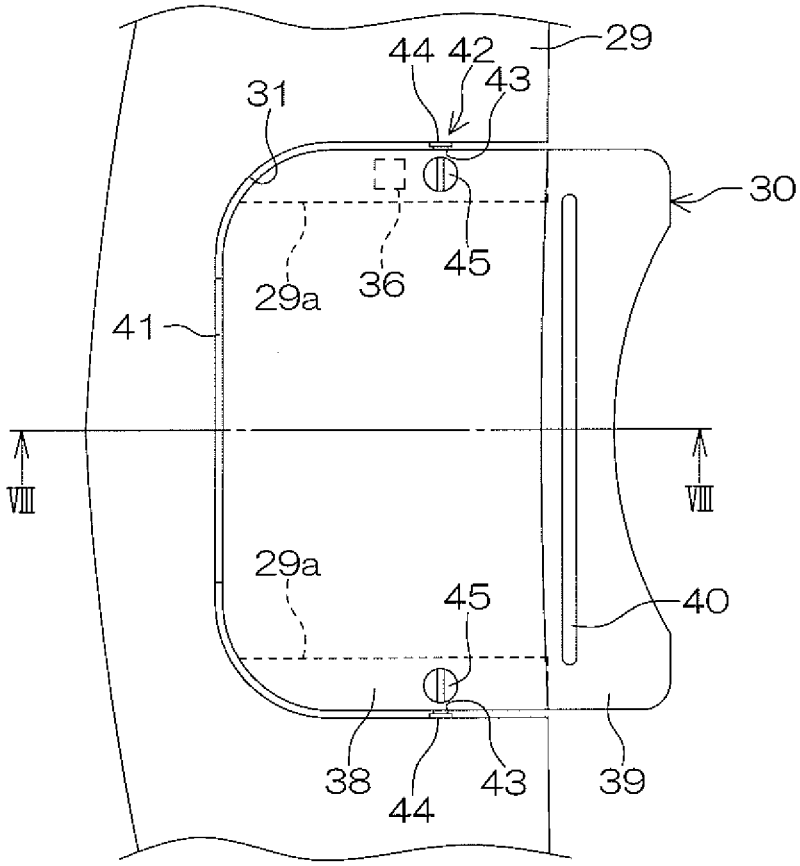
FIG. 6 is a plan view of a hatch and an arrangement relating thereto of the marine vessel according to the first preferred embodiment of the present invention.
Figure 7:
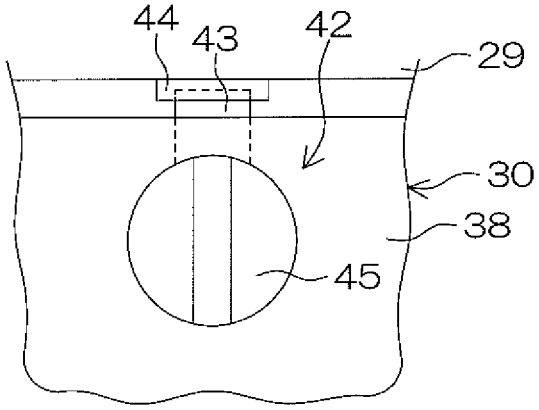
FIG. 7 is an enlarged view of a portion of FIG. 6.
Figure 8:
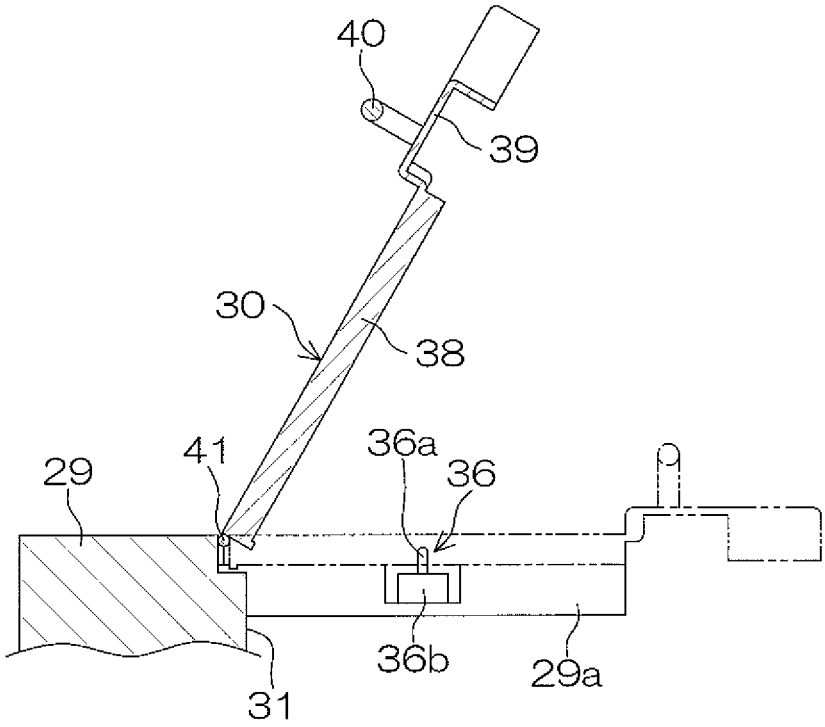
FIG. 8 is a sectional view of the hatch and the arrangement relating thereto, taken along line VIII-VIII in FIG. 6.

FIG. 6 is a plan view of the hatch 30 and an arrangement relating thereto of the marine vessel 1 according to the first preferred embodiment of the present invention. FIG. 7 is an enlarged view of a portion of FIG. 6. FIG. 8 is a sectional view of the hatch 30 and the arrangement relating thereto, taken along line VIII-VIII in FIG. 6. In FIG. 7, a state in which the hatch 30 is locked at the closed position by a lock mechanism 42 is shown. In FIG. 8, the state in which the hatch 30 is at the opened position is shown by the solid line, and the state in which the hatch 30 is at the closed position is shown by the alternate long and two short dashed lines.

As shown in FIG. 6, the hatch 30 has a rectangular shape in a plan view. The hatch 30 includes a tabular portion 38, a stepped portion 39, and a handle 40. As shown in FIG. 8, the rear end portion of the tabular portion 38 is joined to the platform 29 by a hinge 41. The hatch 30 can open and close between the opened position and the closed position around the rear end portion of the tabular portion 38. As shown in FIG. 6 and FIG. 8, the platform 29 includes a pair of support portions 29*a* that support the right end portion and the left end portion of the hatch 30 at the closed position. Therefore, when the hatch 30 is closed, the right end portion and the left end portion of the hatch 30 are supported by the pair of support portions 29*a*. As shown in FIG. 8, in the state in which the hatch 30 is closed, the upper surface of the tabular portion 38 and the upper surface of the platform 29 are positioned on the same plane. The stepped portion 39 is positioned ahead of the tabular portion 38 in the state in which the hatch 30 is closed. Further, the stepped portion 39 is positioned higher than the tabular portion 38 in the state in which the hatch 30 is closed. The handle 40 is attached to the stepped portion 39. In the state in which the hatch 30 is closed, the handle 40 projects upward from the stepped portion 39. The hatch 30 is opened and closed by, for example, an operation of the handle 40 by a marine vessel operator.

The marine vessel 1 includes the lock mechanism 42 that locks the hatch 30 at the closed position. As shown in FIG. 6 and FIG. 7, the lock mechanism 42 includes two projections 43, two fitting members 44, and two operation members 45. The two projections 43 are attached to the right end portion and the left end portion of the hatch 30, respectively. The two projections 43 project rightward and leftward from the side surface of the hatch 30, respectively. The two fitting members 44 correspond to the two projections 43, respectively. Similarly, the two operation members 45 correspond to the two projections 43, respectively. The fitting members 44 are disposed at positions opposed to the corresponding projections 43 in the state in which the hatch 30 is closed. The fitting members 44 are attached to the platform 29. The two operation members 45 are attached to the right end portion and the left end portion of the hatch 30, respectively. Each projection 43 advances and retracts according to an operation of the corresponding operation member 45 by a marine vessel operator. When each projection 43 protrudes in the state in which the hatch 30 is closed, the tip end portion of each projection 43 fits the corresponding fitting member 44. Accordingly, the hatch 30 is locked at the closed position.

The first switch 36 is, for example, a limit switch. As shown in FIG. 8, the first switch 36 is attached to the support portion 29*a*. The first switch 36 includes a first sensor portion 36*a* movable between a closed position and an opened position, and a first switch portion 36*b* that switches between a closed state and an opened state according to the position of the first sensor portion 36*a*. The first sensor portion 36*a* is held at the closed position by a spring (not shown). In the state in which the hatch 30 is opened, the hatch 30 separates from the first sensor portion 36*a*, and the tip end portion of the first sensor portion 36*a* projects upward from the upper surface of the support portion 29*a*. Therefore, in this state, the first sensor portion 36*a* is at the closed position, and the first switch portion 36*b* is closed. When the hatch 30 as a first detection body is moved closer to the closed position, the lower surface of the hatch 30 comes into contact with the first sensor portion 36*a*, and the first sensor portion 36*a* is pushed by the hatch 30. Then, when the hatch 30 is disposed at the closed position, the first sensor portion 36*a* moves to the opened position, and the first switch portion 36*b* switches into the opened state. When the hatch 30 moves from the closed position to the opened position, the first sensor portion 36*a* returns to the closed position, and the first switch portion 36*b* switches into the closed state.

Figure 9:
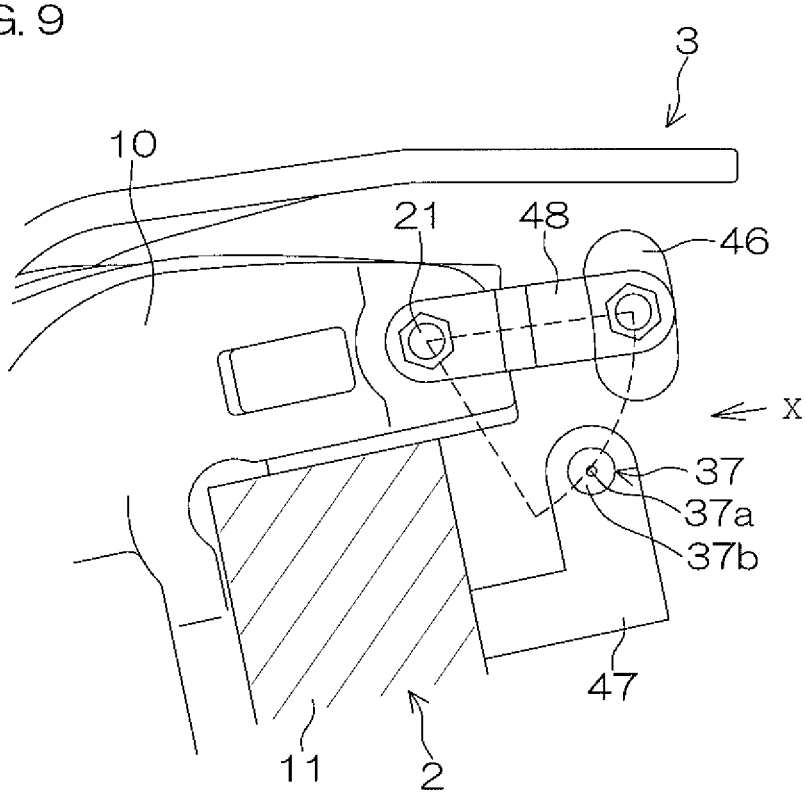
FIG. 9 is a side view of a portion of the marine vessel propulsion apparatus according to the first preferred embodiment of the present invention.
Figure 10:
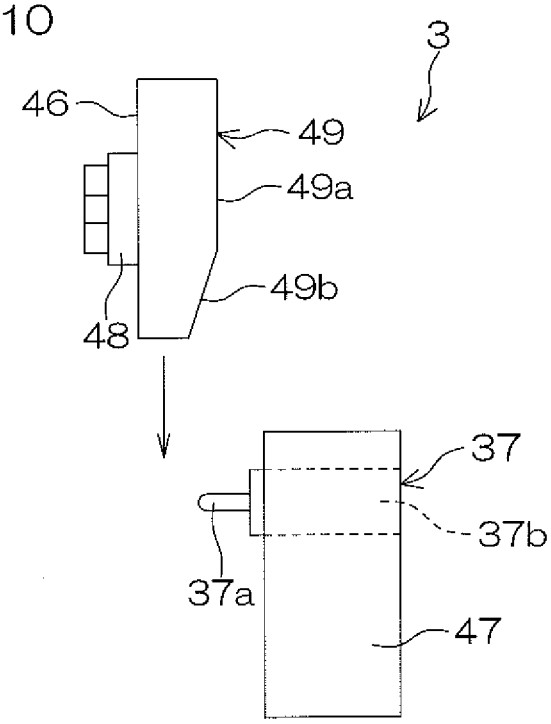
FIG. 10 is a view of the marine vessel propulsion apparatus as viewed in the direction shown by the arrow X in FIG. 9.
Figure 11:
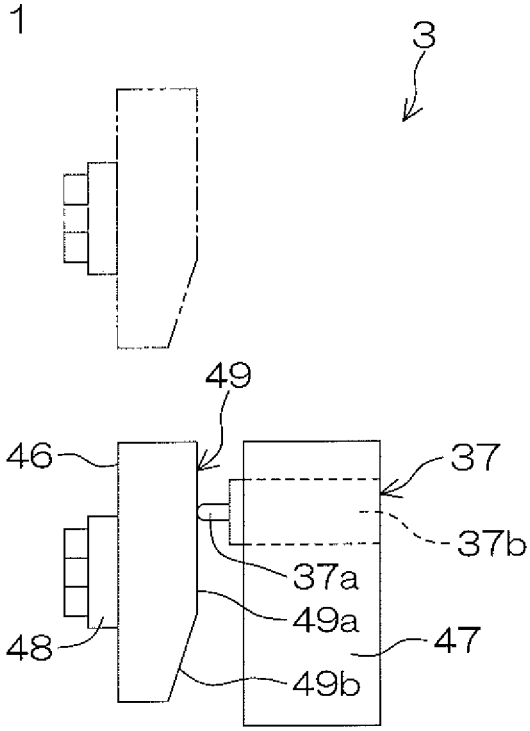
FIG. 11 is a view of the marine vessel propulsion apparatus as viewed in the direction shown by the arrow X in FIG. 9.

FIG. 9 is a side view of a portion (in the vicinity of the tilt shaft 21) of the marine vessel propulsion apparatus 3 according to the first preferred embodiment of the present invention. FIG. 10 and FIG. 11 are views of the marine vessel propulsion apparatus 3 as viewed in the direction shown by the arrow X in FIG. 9. In FIG. 10, the position of a second detection body 46 when the outboard motor 9 is positioned in the trim range is shown. In FIG. 11, a position of the second detection body 46 when the outboard motor 9 is in the trim range is shown by the alternate long and two short dashed lines, and a position of the second detection body 46 when the outboard motor 9 is positioned between the tilt interruption position and the full tilt-up position is shown by the solid line.

The marine vessel propulsion apparatus 3 includes the second detection body 46. Either one of the second switch 37 and the second detection body 46 is joined to the hull 2, and the other is joined to the marine vessel propulsion apparatus 3. As shown in FIG. 9 in the first preferred embodiment, the second switch 37 is joined to the transom 11 via a first bracket 47, and the second detection body 46 is joined to the tilt shaft 21 via a second bracket 48. As shown in FIG. 10, the second detection body 46 includes a cam 49 that has a flat surface 49*a* and an inclined surface 49*b*. The flat surface 49*a* is disposed along a vertical plane, and the inclined surface 49*b* is inclined with respect to the vertical plane. When the outboard motor 9 turns around the tilt shaft 21, the cam 49 turns around the tilt shaft 21 together with the outboard motor 9, and the flat surface 49*a* and the inclined surface 49*b* move up and down. On the other hand, the second switch 37 is joined to the transom 11, so that even when the outboard motor 9 turns around the tilt shaft 21, the second switch 37 does not move. Therefore, when the outboard motor 9 turns around the tilt shaft 21, the second switch 37 and the second detection body 46 move up and down relative to each other.

The second switch 37 is, for example, a limit switch. As shown in FIG. 10, the second switch 37 includes a second sensor portion 37*a* movable between a closed position and an opened position, and a second switch portion 37*b* that switches between a closed state and an opened state according to the position of the second sensor portion 37*a*. The second sensor portion 37*a* is held at the closed position by a spring (not shown). In the state in which the outboard motor 9 is positioned in the trim range, the cam 49 is positioned higher than the second sensor portion 37*a*. Therefore, in the state in which the outboard motor 9 is positioned in the trim range, the second sensor portion 37*a* is not in contact with the cam 39, and is positioned at the closed position. Therefore, in this state, the second switch portion 37*b* is closed. In the tilt-up movement range, a tilt interruption position (the position of the outboard motor 9 shown by the dashed lines in FIG. 2 and FIG. 4) is set. The tilt interruption position is, for example, a position in the tilt range at which the outboard motor 9 and the hatch 30 do not collide with each other in the state in which the hatch 30 is closed. When the outboard motor 9 moves from the trim range to the tilt interruption position, the second switch portion 37*b* switches into the opened state.

In detail, as shown in FIG. 10, when the outboard motor 9 is tilted up from the trim range, the cam 49 moves down toward the second sensor portion 37*a*. Then, when the outboard motor 9 comes closer to the tilt interruption position, the inclined surface 49*b* of the cam 49 comes into contact with the second sensor portion 37*a*, and the second sensor portion 37*a* is pushed toward the opened position. As shown in FIG. 11, when the outboard motor 9 reaches the tilt interruption position, the flat surface 49*a* of the cam 49 comes into contact with the second sensor portion 37*a*, and the second sensor portion 37*a* moves to the opened position. Accordingly, the second switch portion 37*b* switches into the opened state. While the outboard motor 9 is positioned between the tilt interruption position and the full tilt-up position, the second sensor portion 37*a* is in contact with the flat surface 49*a*, and the second switch portion 37*b* is maintained in the opened state. On the other hand, when the outboard motor 9 is tilted down and moves away from the tilt interruption position, the cam 49 separates from the second sensor portion 37*a* and the second sensor portion 37*a* returns to the closed position. Accordingly, the second switch portion 37*b* switches into the closed state.

FIG. 12 is a circuit diagram of a circuit arranged to actuate the PTT device 22 according to the first preferred embodiment of the present invention. In FIG. 12, a state in which the hatch 30 is closed, and the outboard motor 9 is at a position other than a position between the tilt interruption position and the full tilt-up position is shown.

The circuit arranged to actuate the PTT device 22 includes a power supply circuit 50 including a power supply path of the PTT device 22, and a transmission circuit 51 including a transmission path of a tilt-up command and a tilt-down command to be supplied to the PTT device 22. The transmission circuit 51 includes an up command transmission circuit 52 including a tilt-up command transmission path, and a down command transmission circuit 53 including a tilt-down command transmission path. The power supply circuit 50 is a circuit connecting the positive electrode of the battery 28 and a first ground point G1 (a point with the same potential as that of the negative electrode of the battery 28), and the electric motor 27 of the PTT device 22 is disposed in the power supply circuit 50. The transmission circuit 51 is a circuit connecting the positive electrode of the battery 28 and a second ground point G2 (a point with the same potential as that of the negative electrode of the battery 28). The up command transmission circuit 52 and the down command transmission circuit 53 are parallel circuits. The up switch 32 is disposed in the up command transmission circuit 52, and the down switch 33 is disposed in the down command transmission circuit 53. The up switch 32 provided on the remote controller 5 and the up switch 32 provided on the outboard motor 9 are connected in parallel to each other although this is not shown. Similarly, the down switch 33 provided on the remote controller 5 and the down switch 33 provided on the outboard motor 9 are connected in parallel to each other. The tilt movement interruption device 34 is connected to the power supply circuit 50 or the transmission circuit 51 by a connector C. In the first preferred embodiment, the tilt movement interruption device 34 is connected to the up command transmission circuit 52 by the connector C.

The PTT device 22 includes a first relay 54 and a second relay 55 disposed in the circuit arranged to actuate the PTT device 22. The first relay 54 includes a first contact 54*a* movable between a first up position (the position shown in FIG. 12) and a first down position (the position shown by the alternate long and two dashed lines), and a first electromagnet 54*b* that moves the first contact 54*a*. Similarly, the second relay 55 includes a second contact 55*a* movable between a second up position (the position shown in FIG. 12) and a second down position (the position shown by the alternate long and two dashed lines), and a second electromagnet 55*b* that moves the second contact 55*a*. The first contact 54*a* and the second contact 55*a* are disposed in the power supply circuit 50. The first electromagnet 54*b* is disposed in the up command transmission circuit 52, and the second electromagnet 55*b* is disposed in the down command transmission circuit 53. In a state in which the first electromagnet 54*b* and the second electromagnet 55*b* are not supplied with electric power, the first contact 54*a* is held at the first down position, and the second contact 55*a* is held at the second up position.

When the first electromagnet 54*b* is supplied with electric power, the first electromagnet 54*b* moves the first contact 54*a* to the first up position by a magnetic force. When the second electromagnet 55*b* is supplied with electric power, the second electromagnet 55*b* moves the second contact 55*a* to the second down position by a magnetic force. In the state in which the first contact 54*a* is at the first up position and the second contact 55*a* is at the second up position (the state shown in FIG. 12), the electric power of the battery 28 is supplied to the electric motor 27 via the first contact 54*a*. Accordingly, the electric motor 37 rotates in one rotational direction, and the outboard motor 9 is tilted up. On the other hand, in the state in which the first contact 54*a* is at the first down position and the second contact 55*a* is at the second down position, the electric power of the battery 28 is supplied to the electric motor 27 via the second contact 55*a*. Accordingly, the electric motor 27 rotates in the other rotational direction opposite to the one rotational direction, and the outboard motor 9 is tilted down.

The up switch 32 and the down switch 33 are held in the opened state in a non-operated state. In FIG. 12, a state in which the up switch 32 is operated and the down switch 33 is not operated is shown. During the operation of the up switch 32, the up switch 32 is held in the closed state, and a tilt-up command is given to the PTT device 22. Specifically, the electric power of the battery 28 is supplied to the first electromagnet 54*b*, and the first contact 54*a* moves from the first down position to the first up position. Accordingly, the outboard motor 9 is tilted up. On the other hand, during the operation of the down switch 33, the down switch 33 is held in the closed state, and a tilt-down command is given to the PIT device 22. Specifically, the electric power of the battery 28 is supplied to the second electromagnet 55*b*, and the second contact 55*a* moves from the second up position to the second down position. Accordingly, the outboard motor 9 is tilted down.

The ON/OFF switch 35 is connected to the up command transmission circuit 52 between the first electromagnet 54*b* and the up switch 32. The ON/OFF switch 35 may be connected to the up command transmission circuit 52 between the positive electrode of the battery 28 and the first electromagnet 54*b*, or may be connected to the up command transmission circuit 52 between the second ground point G2 and the up switch 32. The ON/OFF switch 35 is connected in series to the up switch 32. Specifically, the first switch 36 and the second switch 37 provided in the ON/OFF switch 35 are connected in series to the up switch 32. On the other hand, the first switch 36 and the second switch 37 are connected in parallel.

In the state in which the hatch 30 is closed, the first switch 36 is opened, and energization at the first switch 36 is blocked. On the other hand, in the state in which the hatch 30 is opened, the first switch 36 is closed, and energization at the first switch 36 is kept. In the state in which the outboard motor 9 is positioned in the range between the tilt interruption position and the full tilt-up position, the second switch 37 is opened, and energization at the second switch 37 is blocked. On the other hand, in the state in which the outboard motor 9 is positioned out of this range, the second switch 37 is closed, and energization at the second switch 37 is kept.

The tilt-up stop condition is established by closing of the hatch 30 and positioning of the outboard motor 9 between the tilt interruption position and the full tilt-up position. Specifically, the tilt-up stop condition is established when an obstacle is present in the tilt-up movement range of the outboard motor 9 and the obstacle and the outboard motor 9 are equal to or less than a predetermined distance from each other. In the state in which the hatch 30 is closed and the outboard motor 9 is positioned between the tilt interruption position and the full tilt-up position, energization is blocked at both switches 36 and 37. Therefore, when the tilt-up stop condition is established, energization is blocked at both switches 36 and 37.

As described above, the first switch 36 and the second switch 37 are connected to the up command transmission circuit 52. The first switch 36 and the second switch 37 are connected in parallel. Therefore, when energization is kept in at least one of the first switch 36 and the second switch 37, the up command transmission circuit 52 is not cut off. For example, when the hatch 30 is opened, the second switch 37 is closed, so that even if the outboard motor 9 is tilted up to the tilt interruption position, the up command transmission circuit 52 is not cut off. Therefore, when the operation of the up switch 32 is continued, the outboard motor 9 is tilted up to the full tilt-up position. However, when the tilt-up stop condition is established, both switches 36 and 37 are opened, so that the up command transmission circuit 52 is cut off. Therefore, when the tilt-up stop condition is established during the operation of the up switch 32, the tilt-up movement of the outboard motor 9 is interrupted.

In detail, for example, in the state in which the outboard motor 9 is positioned in the trim range, the first switch 36 is closed, and the up command transmission circuit 52 is not cut off. Therefore, in this state, when the up switch 32 is operated, the outboard motor 9 is tilted up regardless of whether the hatch 30 is closed. Then, when the operation of the up switch 32 is continued, the outboard motor 9 reaches the tilt interruption position. Therefore, the first switch 36 switches into the opened state. At this time, when the hatch 30 is closed, both switches 36 and 37 turn into the opened state, and the up command transmission circuit 52 is cut off. Specifically, when the tilt-up stop condition is established during the operation of the up switch 32, the up command transmission circuit 52 is cut off and tilt-up of the outboard motor 9 is temporarily stopped. The tilt movement interruption device 34 thus interrupts the tilt-up movement of the outboard motor 9 by interfering with the operation of the PTT device 22.

On the other hand, even when the tilt-up movement of the outboard motor 9 is interrupted, if the tilt-up stop condition becomes canceled after the interruption, tilt-up of the outboard motor 9 is restarted. In detail, for example, even when the tilt-up movement of the outboard motor 9 is interrupted, if the hatch 30 is opened thereafter, the tilt-up stop condition becomes canceled, and the first switch 36 switches into the closed state. Therefore, the up command transmission circuit 52 is connected again. Therefore, after the tilt-up movement of the outboard motor 9 is interrupted, when the hatch 30 is opened and the hatch 30 as an obstacle is excluded from the tilt-up movement range, the tilt-up movement of the outboard motor 9 is restarted. Until the tilt-up movement is restarted after it is interrupted, the up switch 32 may be continuously operated, or may be temporarily stopped and then operated again.

As described above, in the first preferred embodiment, the tilt movement interruption device 34 includes the ON/OFF switch 35 disposed in the circuit arranged to actuate the PTT device 22. The circuit arranged to actuate the PTT device 22 is opened and closed by the ON/OFF switch 35. Specifically, when the tilt-up stop condition is established, the circuit arranged to actuate the PTT device 22 is cut off, and unless the tilt-up stop condition is established, the circuit is connected. Therefore, when the tilt-up stop condition of the outboard motor 9 is established during the operation of the up switch 32, the circuit arranged to actuate the PTT device is cut off and tilt-up of the outboard motor 9 is stopped. When the tilt-up stop condition becomes canceled after tilt-up of the outboard motor 9 is stopped according to establishment of the tilt-up stop condition, the circuit arranged to actuate the PTT device 22 is connected, so that tilt-up of the outboard motor 9 is restarted. Therefore, after interrupting the tilt-up movement of the outboard motor 9, the tilt movement interruption device 34 can restart this movement and tilt up the outboard motor 9 to a larger angle.

Second Preferred Embodiment

Figure 13:
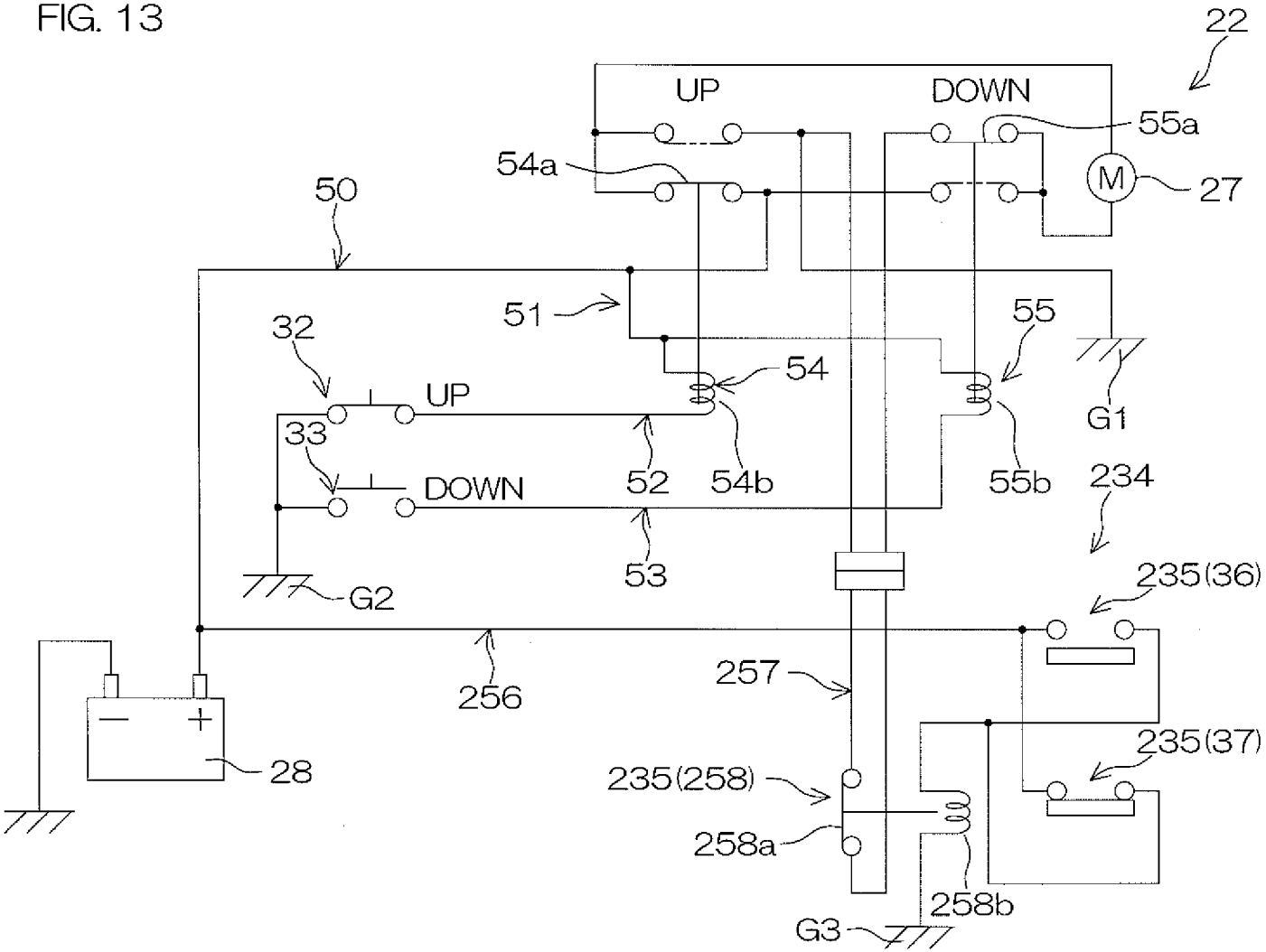
FIG. 13 is a circuit diagram of a circuit arranged to actuate the PTT device according to a second preferred embodiment of the present invention.

FIG. 13 is a circuit diagram of a circuit arranged to actuate the PTT device 22 according to a second preferred embodiment of the present invention. In FIG. 13, a state in which the hatch 30 is closed and the outboard motor 9 is at a position other than a position between the tilt interruption position and the full tilt-up position is shown. In this FIG. 13, components equivalent to those shown in FIG. 1 to FIG. 12 will be provided with reference numerals as in FIG. 1, etc., and description thereof will be omitted.

A major difference between the second preferred embodiment and the above-described first preferred embodiment is that the connecting position of the tilt movement interruption device to the circuit arranged to actuate the PTT device is different. Specifically, while the tilt movement interruption device is connected to the up command transmission circuit in the first preferred embodiment, the tilt movement interruption device is connected to the power supply circuit in the second preferred embodiment.

In detail, the tilt movement interruption device 234 includes a first circuit 256 and a second circuit 257. The ON/OFF switch 235 includes the first switch 36, the second switch 37, and a third relay 258. The first circuit 256 is a circuit that connects the positive electrode of the battery 28 and a third ground point G3 (a point with the same potential as that of the negative electrode of the battery 23). The second circuit 257 is a circuit connected in series to the power supply circuit 50. The third relay 258 includes a third contact 258*a* movable between an opened position and a closed position, and a third electromagnet 258*b* that moves the third contact 258*a*. The third contact 258*a* is disposed in the second circuit 257, and the third electromagnet 258*b* is disposed in the first circuit 256. Electric power of the battery 28 is supplied to the third electromagnet 258*b*. In a state in which the third electromagnet 258*b* is not supplied with electric power, the third contact 258*a* is held at the opened position. When the third electromagnet 258*b* is supplied with electric power, the third contact 258*a* is held at the closed position by a magnetic force of the third electromagnet 258*b*. Therefore, when the electric power supply to the third electromagnet 258*b* is stopped, the second circuit 257 is cut off and the power supply circuit 50 is cut off.

The first switch 36 and the second switch 37 provided in the ON/OFF switch 235 are disposed in the first circuit 256. The first switch 36 and the second switch 37 are connected in series to the third electromagnet 258*b*. Further, the first switch 36 and the second switch 37 are connected in parallel. The tilt-up stop condition is established when the hatch 30 is closed and the outboard motor 9 is positioned between the tilt interruption position and the full tilt-up position. Specifically, the tilt-up stop condition is established when an obstacle is present in the tilt-up movement range of the outboard motor 9, and the obstacle and the outboard motor 9 are equal to or less than a predetermined distance from each other. In the state in which the hatch 30 is closed and the outboard motor 9 is positioned at the tilt interruption position, both switches 36 and 37 are opened, and the first circuit 256 is cut off. Therefore, in this state, the third contact 258*a* is held at the opened position, and the power supply circuit 50 is cut off. Therefore, when the tilt-up stop condition is established during the operation of the up switch 32, the power supply circuit 50 is cut off, and the tilt-up movement of the outboard motor 9 is interrupted. After the tilt-up movement is interrupted, when the tilt-up stop condition becomes canceled, tilt-up of the outboard motor 9 is restarted.

Third Preferred Embodiment

Figure 14:
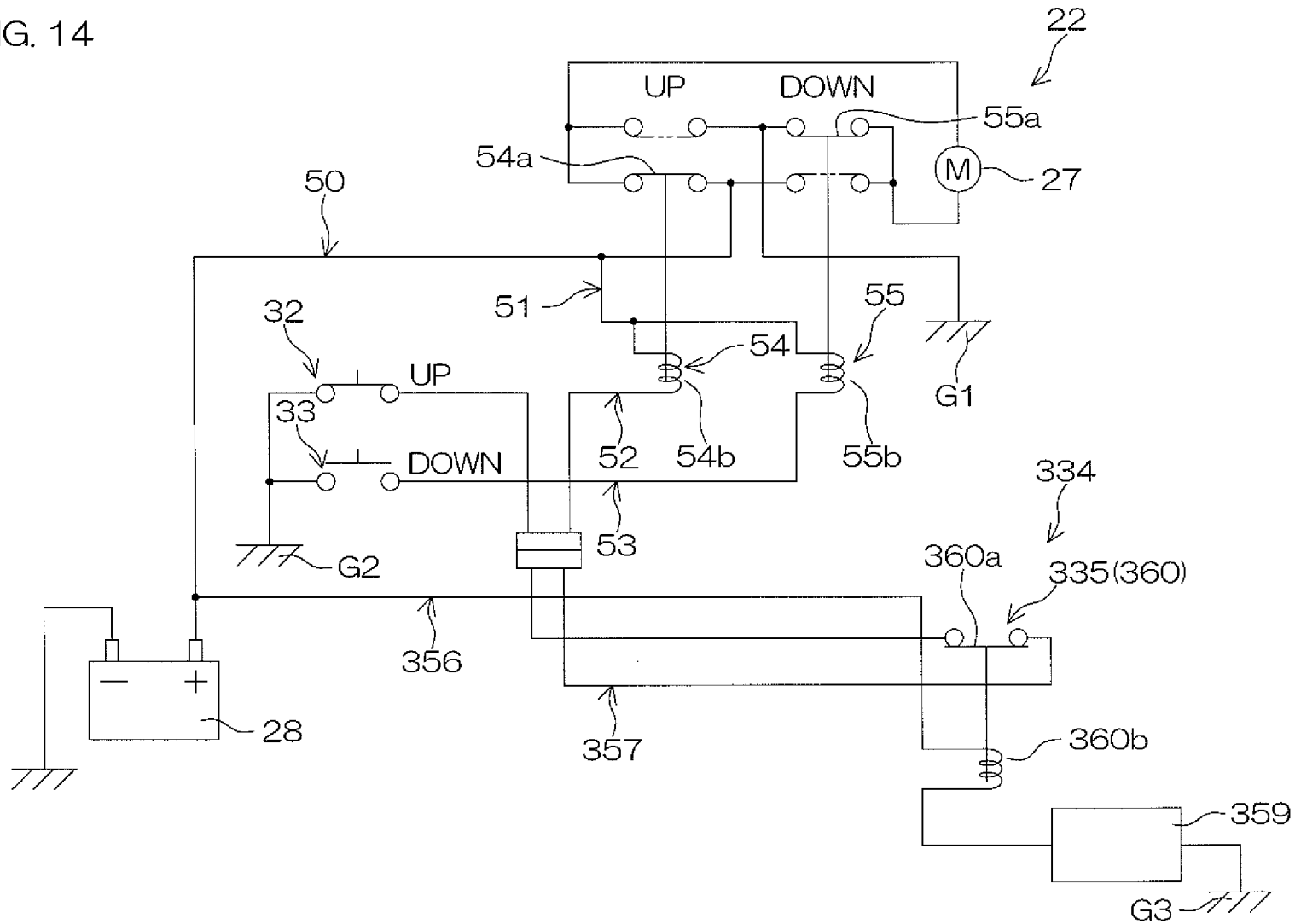
FIG. 14 is a circuit diagram of a circuit arranged to actuate the PTT device according to a third preferred embodiment of the present invention.
Figure 15:
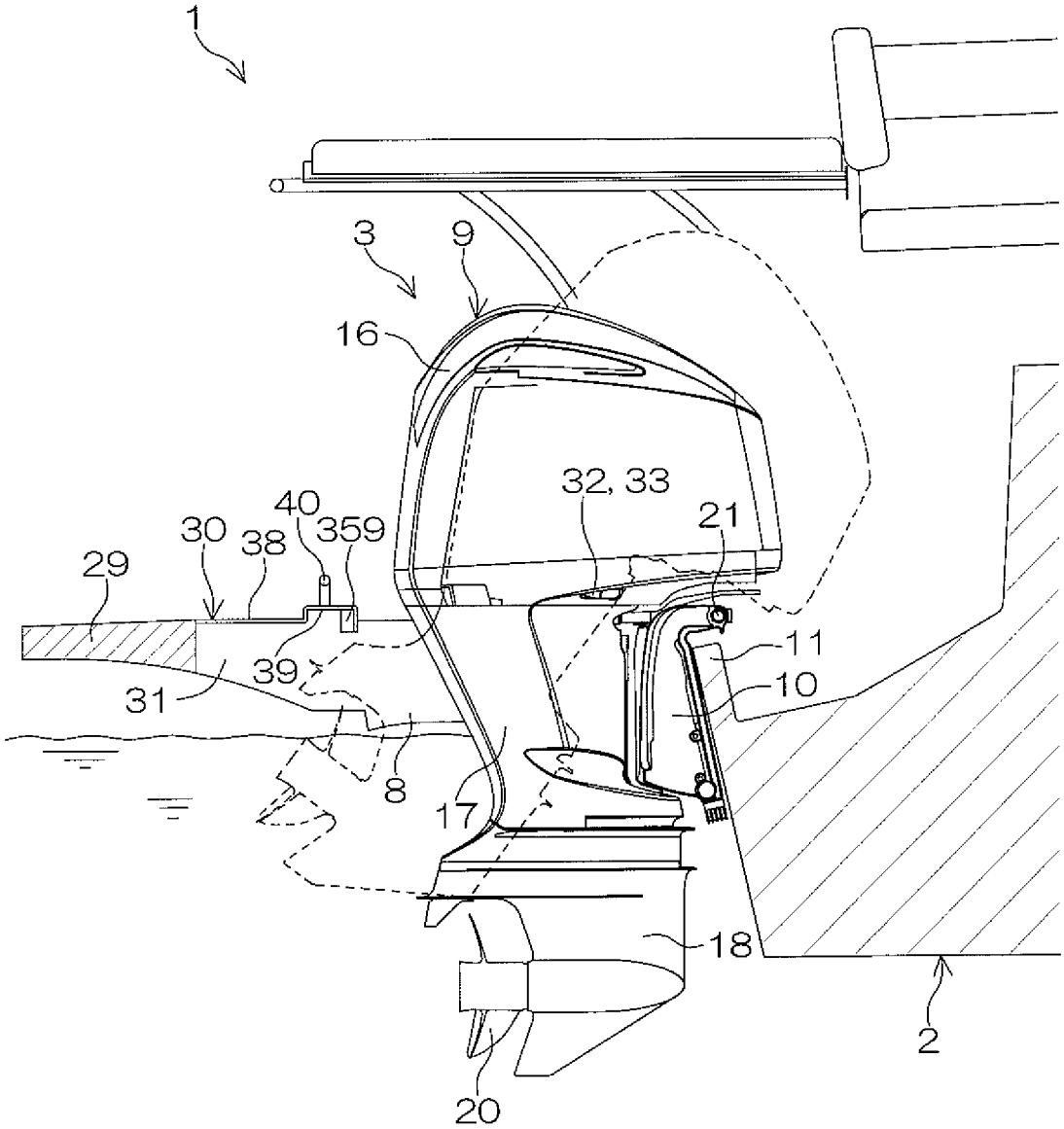
FIG. 15 is a partial sectional view of a rear portion of a marine vessel according to the third preferred embodiment of the present invention.

FIG. 14 is a circuit diagram of a circuit arranged to actuate the PTT device 22 according to a third preferred embodiment of the present invention. FIG. 15 is a partial sectional view of the rear portion of a marine vessel 1 according to the third preferred embodiment of the present invention is shown. In FIG. 14 and FIG. 15, a state in which the hatch 30 is closed and the outboard motor 9 is at a position other than a position between the tilt interruption position and the full tilt-up position is shown. In FIG. 14 and FIG. 15, components equivalent to those shown in FIG. 1 to FIG. 13 will be provided with reference numerals as in FIG. 1, etc., and description thereof will be omitted.

A major difference between the third preferred embodiment and the above-described first preferred embodiment is that the tilt movement interruption device includes a proximity sensor that is a non-contact switch instead of the first switch and the second switch that are contact switches.

In detail, as shown in FIG. 14, the tilt movement interruption device 334 includes a first circuit 356, a second circuit 357, and a proximity sensor 359. The first circuit 356 is a circuit that connects the positive electrode of the battery 28 and the third ground point G3. The second circuit 357 is a circuit connected in series to the up command transmission circuit 52. The proximity sensor 359 is disposed in the first circuit 356. The electric power of the battery 28 is supplied to the proximity sensor 359. The ON/OFF switch 335 includes a fourth relay 360. The fourth relay 360 includes a fourth contact 360*a* movable between an opened position and a closed position, and a fourth electromagnet 360*b* that moves the fourth contact 360*a*. The fourth contact 360*a* is disposed in the second circuit 357, and the third electromagnet 258*b* is disposed in the first circuit 356. The fourth electromagnet 360*b* and the proximity sensor 359 are connected in series. In a state in which the fourth electromagnet 360*b* is not supplied with electric power, the fourth contact 360*a* is held at the opened position. When the fourth electromagnet 360*b* is supplied with electric power, the fourth contact 360*a* is held at the closed position by a magnetic force of the fourth electromagnet 360*b*. Therefore, when the electric power supply to the fourth electromagnet 360*b* is stopped, the second circuit 357 is cut off, and the up command transmission circuit 52 is cut off.

As shown in FIG. 15, the proximity sensor 359 is attached to the hatch 30. The proximity sensor 359 moves together with the hatch 30. The detection target of the proximity sensor 359 is a metallic portion of the outboard motor 9. The proximity sensor 359 may be attached to the outboard motor 9 instead of the hatch 30. The proximity sensor 359 switches between a closed state and an opened state according to the distance between the outboard motor 9 and the hatch 30. Specifically, when the outboard motor 9 and the hatch 30 are not close to each other, the proximity sensor 359 is in the closed state, and when the outboard motor 9 and the hatch 30 are equal to or less than a predetermined distance from each other, the proximity sensor 359 is in the opened state. The fourth relay 360 is turned off when the proximity sensor 359 detects that the outboard motor 9 and the hatch 30 are equal to or less than the predetermined distance from each other. Unless the proximity sensor 359 detects that the outboard motor 9 and the hatch 30 are equal to or less than the predetermined distance from each other, the fourth relay 360 is turned on.

In detail, when the outboard motor 9 is tilted up to the tilt interruption position in the state in which the hatch 30 is closed, and the outboard motor 9 and the hatch 30 are equal to or less than a predetermined distance from each other, the proximity sensor 359 switches from the closed state into the opened state. When the proximity sensor 359 is in the closed state, the fourth electromagnet 360*b* is supplied with electric power and the fourth contact 360*a* is held at the closed position. On the other hand, when the proximity sensor 359 is in the opened state, the electric power supply to the fourth electromagnet 360*b* is stopped. Therefore, when the proximity sensor 359 is in the opened state, the fourth contact 360*a* is at the opened position, and the second circuit 357 is cut off. Therefore, when the proximity sensor 359 detects that the outboard motor 9 and the hatch 30 are equal to or less than the predetermined distance from each other, the fourth relay 360 is turned off. Unless the proximity sensor 359 detects that the outboard motor 9 and the hatch 30 are equal to or less than the predetermined distance from each other, the fourth relay 360 is turned on.

Thus, the proximity sensor 359 switches into the opened state when the outboard motor 9 is tilted up to the tilt interruption position in the state in which the hatch 30 is closed. The tilt-up stop condition is established when the hatch 30 is closed and the outboard motor 9 is positioned between the tilt interruption position and the full tilt-up position. Specifically, the tilt-up stop condition is established when an obstacle is present in the tilt-up movement range of the outboard motor 9 and the obstacle and the outboard motor 9 are equal to or less than the predetermined distance from each other. Therefore, when the tilt-up stop condition is established during the operation of the up switch 32, the proximity sensor 359 switches into the opened state, and the up command transmission circuit 52 is cut off. Accordingly, the tilt-up movement of the outboard motor 9 is interrupted. After the tilt-up movement is interrupted, when the tilt-up stop condition becomes canceled, the proximity sensor 359 switches into the closed state, and tilt-up of the outboard motor 9 is restarted.

Fourth Preferred Embodiment

Figure 16:
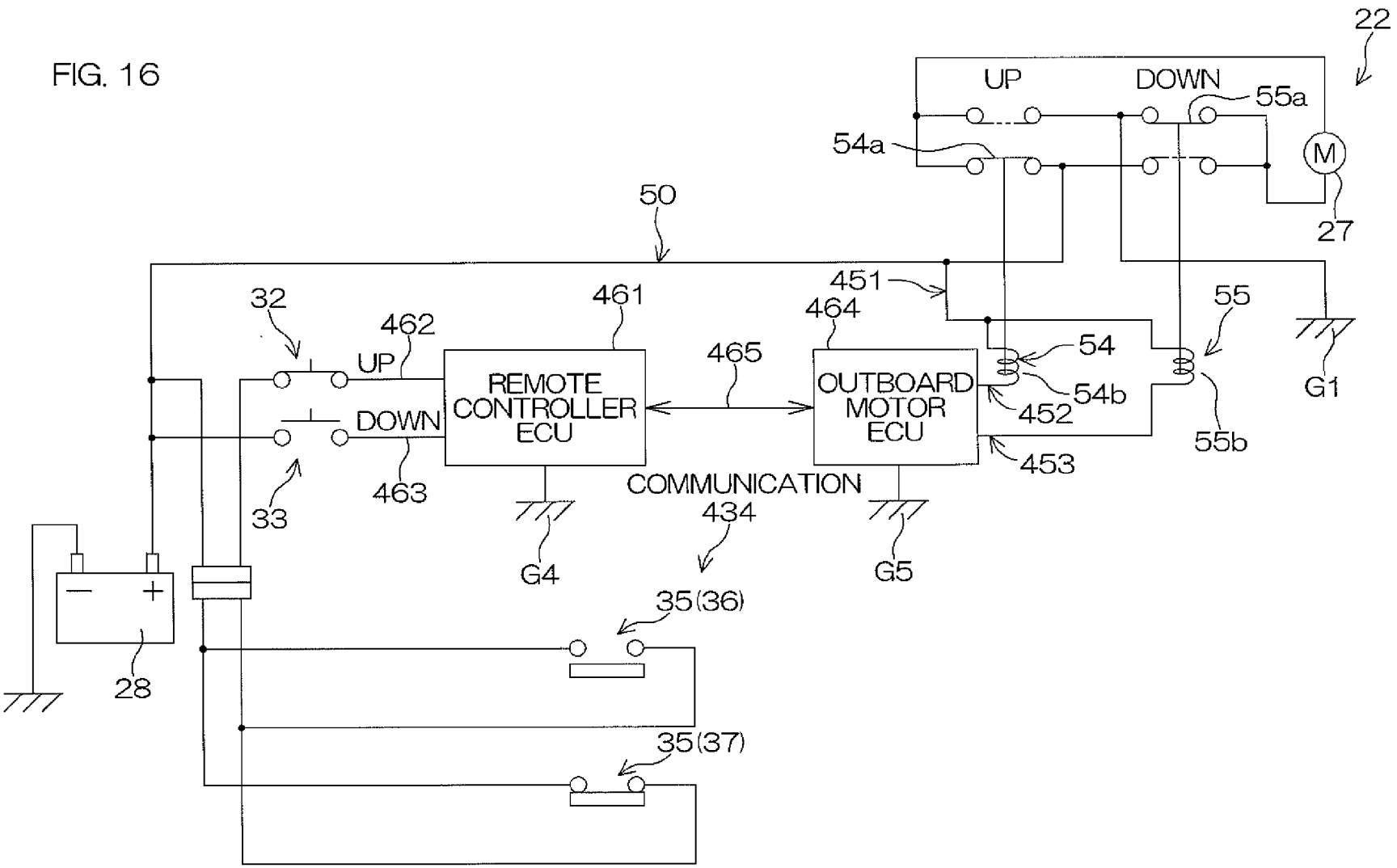
FIG. 16 is a circuit diagram of a circuit arranged to actuate the PTT device according to a fourth preferred embodiment of the present invention.

FIG. 16 is a circuit diagram of a circuit arranged to actuate the PTT device 22 according to a fourth preferred embodiment of the present invention. In FIG. 16, a state in which the hatch 30 is closed and the outboard motor 9 is at a position other than a position between the tilt interruption position and the full tilt-up position is shown. In this FIG. 16, components equivalent to those shown in FIG. 1 to FIG. 15 will be provided with reference numerals, and description thereof will be omitted.

A major difference between the fourth preferred embodiment and the above-described first preferred embodiment is that a tilt-up execution signal to actuate the PTT device and tilt up the outboard motor is transmitted from a remote controller ECU installed inside the remote controller to an outboard motor ECU installed inside the outboard motor.

In detail, the remote controller 5 further includes the remote controller ECU 461 (electronic control unit) installed inside the remote controller 5. The remote controller ECU 461 is disposed in an up operation transmission circuit 462 including a transmission path of an up switch operation signal, and a down operation transmission circuit 463 including a transmission path of a down switch operation signal. The up operation transmission circuit 462 and the down operation transmission circuit 463 are circuits that connect the positive electrode of the battery 28 and a fourth ground point G4 (a point with the same potential as that of the negative electrode of the battery 28). The up operation transmission circuit 462 and the down operation transmission circuit 463 are parallel circuits. The up switch 32 is disposed in the up operation transmission circuit 462, and the down switch 33 is disposed in the down operation transmission circuit 463. The up switch 32 is positioned between the remote controller ECU 461 and the battery 28, and the down switch 33 is positioned between the remote controller ECU 461 and the battery 28. The up switch 32 and the down switch 33 are connected in series to the remote controller ECU 461.

The outboard motor 9 further includes the outboard motor ECU 464 (electronic control unit) installed inside the outboard motor 9. The outboard motor ECU 464 is disposed in an up command transmission circuit 452 and a down command transmission circuit 453 of a transmission circuit 451. The transmission circuit 451 is a circuit connecting the positive electrode of the battery 28 and a fifth ground point G5 (point with the same potential as that of the negative electrode of the battery 28). The up command transmission circuit 452 and the down command transmission circuit 453 are parallel circuits. The first electromagnet 54*b* of the first relay 54 is disposed in the up operation transmission circuit 462, and the second electromagnet 55*b* of the second relay 55 is disposed in the down operation transmission circuit 463. The first electromagnet 54*b* is positioned between the outboard motor ECU 464 and the battery 28, and the second electromagnet 55*b* is positioned between the outboard motor ECU 464 and the battery 28. The first electromagnet 54*b* and the second electromagnet 55*b* are connected in series to the outboard motor ECU 464. The outboard motor ECUU 464 and the remote controller ECU 461 communicate with each other via an onboard LAN 465 (Local Area Network) provided inside the hull 2.

A tilt movement interruption device 434 is connected to the up operation transmission circuit 462 between the positive electrode of the battery 28 and the up switch 32. The tilt movement interruption device 434 may be connected to the up operation transmission circuit 462 between the up switch 32 and the remote controller ECU 461, or may be connected to the up operation transmission circuit 462 between the remote controller ECU 461 and the fourth ground point G4. When at least one of the first switch 36 and the second switch 37 is closed, the tilt movement interruption device 434 connects the up operation transmission circuit 462. On the other hand, when both switches 36 and 37 are opened, the tilt movement interruption device 434 cuts off the up operation transmission circuit 462. The tilt-up stop condition is established when the hatch 30 is closed and the outboard motor 9 is positioned between the tilt interruption position and the full tilt-up position. Specifically, the tilt-up stop condition is established when an obstacle is present in the tilt-up movement range of the outboard motor 9, and the obstacle and the outboard motor 9 are equal to or less than a predetermined distance from each other. Therefore, when the tilt-up stop condition is established, both switches 36 and 37 switch from the closed state into the opened state, and the up operation transmission circuit 462 is cut off.

When the down switch 33 is operated, a down switch operation signal is input into the remote controller ECU 461, and the remote controller ECU 461 actuates the PTT device 22 to output a tilt-down execution signal to tilt down the outboard motor 9. The tilt-down execution signal output from the remote controller ECU 461 is transmitted to the outboard motor ECU 464 by the onboard LAN 465. The outboard motor ECU 464 cuts off the down command transmission circuit 453 by cutting off the internal circuit of the outboard motor ECU 464. The outboard motor ECU 464 connects the down command transmission circuit 453 by connecting the internal circuit of the outboard motor ECU 464 when the outboard motor ECU 464 receives the tilt-down execution signal. Accordingly, a tilt-down command is given to the PTT device 22. Specifically, in the state in which the electric power of the battery 28 is supplied to the second electromagnet 55*b* and the first contact 54*a* is at a first down position (the position shown by the alternate long and two short dashed lines), the second contact point 55*a* moves from a second up position (the position shown in FIG. 16) to a second down position (the position shown by the alternate long and two short dashed lines). Accordingly, the electric motor 27 is driven and the outboard motor 9 is tilted down.

On the other hand, when the up switch 32 is operated in the case where the tilt-up stop condition is not established, an up switch operation signal is input into the remote controller ECU 461, and the remote controller ECU 461 outputs a tilt-up execution signal to actuate the PTT device 22 and tilt up the outboard motor 9. The tilt-up execution signal output from the remote controller ECU 461 is transmitted to the outboard motor ECU 464 by the onboard LAN 465. The outboard motor ECU 464 cuts off the up command transmission circuit 452 by cutting off the internal circuit of the outboard motor ECU 464. The outboard motor ECU 464 connects the up command transmission circuit 452 by connecting the internal circuit of the outboard motor ECU 464 when it receives the tilt-up execution signal. Accordingly, a tilt-up command is given to the PTT device 22. Specifically, in the state in which the electric power of the battery 28 is supplied to the first electromagnet 54*b* and the second contact 55*a* is at a second up position (the position shown in FIG. 16), the first contact 54*a* moves from a first down position (the position shown by the alternate long and two short dashed lines) to a first up position (the position shown in FIG. 16). Accordingly, the electric motor 27 is driven and the outboard motor 9 is tilted up.

On the other hand, when the up switch 32 is operated while the tilt-up stop condition is established, the up operation transmission circuit 462 is cut off, so that no up switch operation signal is generated. Therefore, even if the up switch 32 is operated when the tilt-up stop condition is established, no up switch operation signal is input into the remote controller ECU 461, so that the remote controller ECU 461 does not output a tilt-up execution signal. Specifically, when the tilt-up stop condition is established, even if the up switch 32 is operated, the remote controller ECU 461 does not output a tilt-up execution signal to the outboard motor 9. Therefore, when the tilt-up stop condition is established during the operation of the up switch 32, the remote controller ECU 461 stops the output of the tilt-up execution signal, and stops the tilt-up movement of the outboard motor 9. Thereafter, when the tilt-up stop condition becomes canceled, the remote controller ECU 461 restarts the output of the tilt-up execution signal and restarts the tilt-up movement of the outboard motor 9.

Fifth Preferred Embodiment

Figure 17:
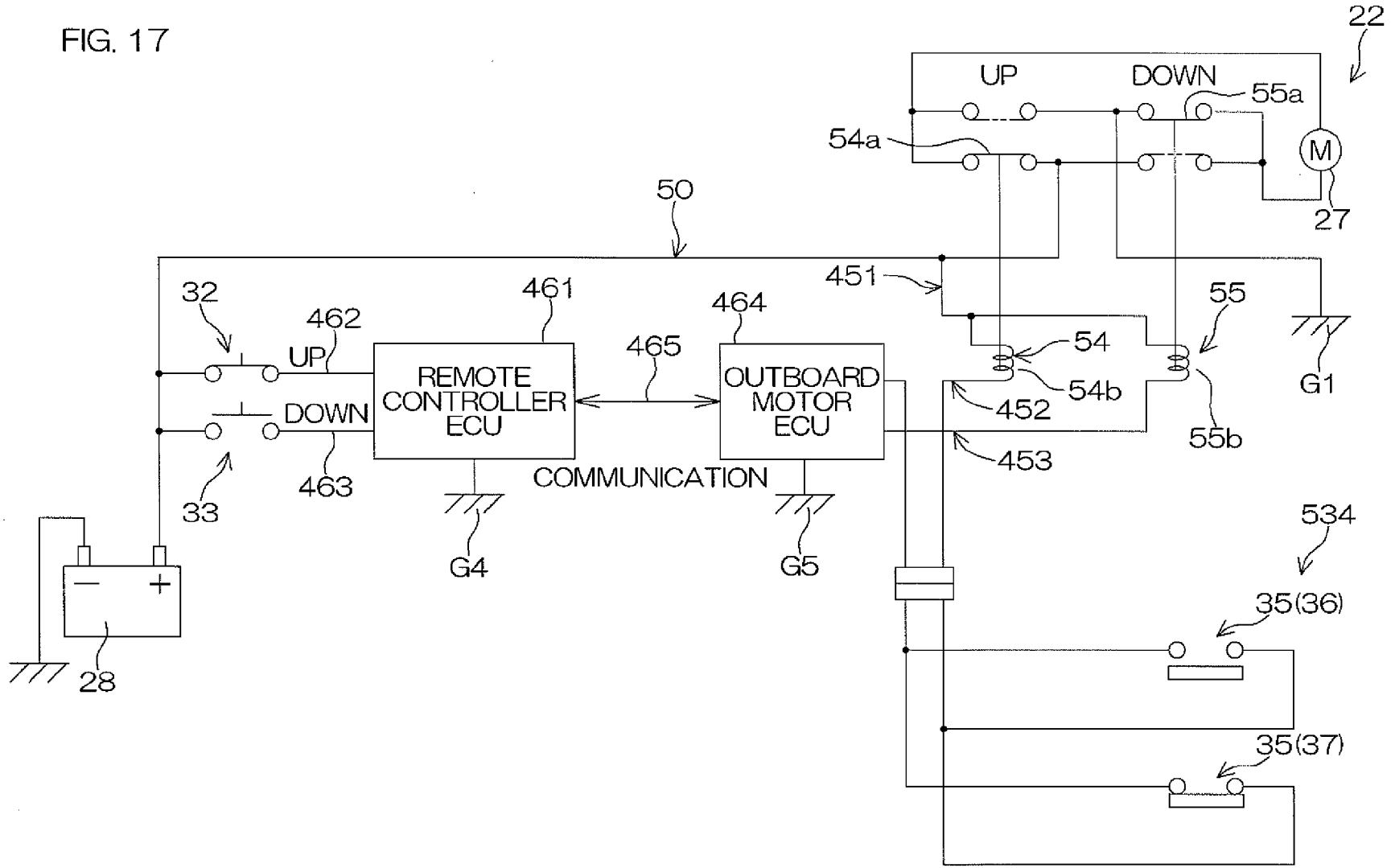
FIG. 17 is a circuit diagram of a circuit arranged to actuate the PTT device according to a fifth preferred embodiment of the present invention.

FIG. 17 is a circuit diagram of a circuit arranged to actuate the PTT device 22 according to a fifth preferred embodiment of the present invention. In FIG. 17, a state in which the hatch 30 is closed and the outboard motor 9 is at a position other than a position between the tilt interruption position and the full tilt-up position is shown. In this FIG. 17, components equivalent to those shown in FIG. 1 to FIG. 16 will be provided with reference numerals as in FIG. 1, etc., and description thereof will be omitted.

A major difference between the fifth preferred embodiment and the above-described fourth preferred embodiment is that the connecting position of the tilt movement interruption device to the circuit arranged to actuate the PTT device is different. Specifically, while the tilt movement interruption device is connected to the up operation transmission circuit in the fourth preferred embodiment, the tilt movement interruption device is connected to the up command transmission circuit in the fifth preferred embodiment.

In detail, a tilt movement interruption device 534 is connected to the up command transmission circuit 452 between the outboard motor ECU 464 and the first electromagnet 54*b* of the first relay 54. The tilt movement interruption device 534 may be connected to the up command transmission circuit 452 between the battery 28 and the first electromagnet 54*b* of the first relay 54, or may be connected to the up command transmission circuit 452 between the outboard motor ECU 464 and the fifth ground point G5. The tilt-up stop condition is established when an obstacle is present in the tilt-up movement range of the outboard motor 9, and the obstacle and the outboard motor 9 are equal to or less than a predetermined distance from each other. When the tilt-up stop condition is established, both switches 36 and 37 are opened, and the tilt movement interruption device 534 cuts off the up command transmission circuit 452. On the other hand, when the tilt-up stop condition is not established, at least one of the first switch 36 and the second switch 37 is closed, and the tilt movement interruption device 534 connects the up command transmission circuit 452.

When the up switch 32 is operated, an up switch operation signal is input into the remote controller ECU 461, and the remote controller ECU 461 outputs a tilt-up execution signal. The tilt-up execution signal output from the remote controller ECU 461 is transmitted to the outboard motor ECU 464 by the onboard LAN 465. When the outboard motor ECU 464 receives the tilt-up execution signal, it connects the internal circuit of the outboard motor ECU 464.

When the tilt-up stop condition is not established, the up command transmission circuit 452 is not cut off by the tilt movement interruption device 534, so that the electric power of the battery 28 is supplied to the first electromagnet 54*b*. Accordingly, in the state in which the second contact 55*a* is at a second up position (the position shown in FIG. 17), the first contact 54*a* moves from a first down position (the position shown by the alternate long and two short dashed lines) to a first up position (the position shown in FIG. 17), and the outboard motor 9 is tilted up.

When the tilt-up stop condition is established, the up command transmission circuit 452 is cut off by the tilt movement interruption device 534. Therefore, when the tilt-up stop condition is established, even if the outboard motor ECU 464 connects the internal circuit of the outboard motor ECU 464, the electric power of the battery 28 is not supplied to the first electromagnet 54*b*. Therefore, the outboard motor 9 is not tilted up. Accordingly, when the tilt-up stop condition is established during the operation of the up switch 32, the electric power supply to the first electromagnet 54*b* is stopped, and the tilt-up movement of the outboard motor, 9 is interrupted. Thereafter, when the tilt-up stop condition becomes canceled, the first electromagnet 54*b* is supplied with electric power again, and the tilt-up movement of the outboard motor 9 is restarted.

Sixth Preferred Embodiment

Figure 18:
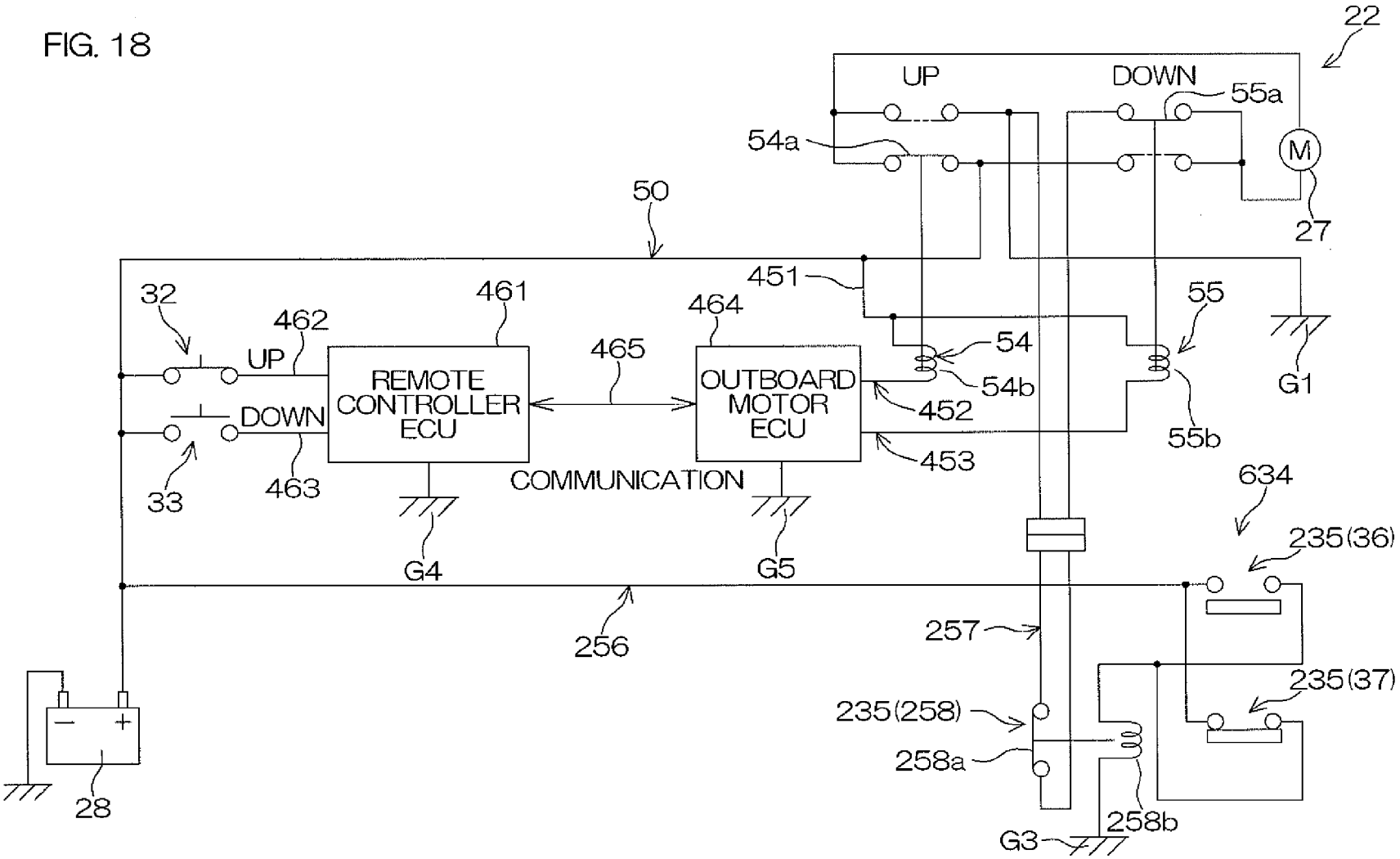
FIG. 18 is a circuit diagram of a circuit arranged to actuate the PTT device according to a sixth preferred embodiment of the present invention.

FIG. 18 is a circuit diagram of a circuit arranged to actuate the PTT device 22 according to a sixth preferred embodiment of the present invention. In FIG. 18, a state in which the hatch 30 is closed and the outboard motor 9 is at a position other than a position between the tilt interruption position and the full tilt-up position is shown. In this FIG. 18, components equivalent to those shown in FIG. 1 to FIG. 17 will be provided with reference numerals as in FIG. 1, etc., and description thereof will be omitted.

A major difference between the sixth preferred embodiment and the above-described fourth preferred embodiment is that the connecting position of the tilt movement interruption device to the circuit arranged to actuate the PTT device is different. Specifically, while the tilt movement interruption device is connected to the up operation transmission circuit in the fourth preferred embodiment, the tilt movement interruption device is connected to the power supply circuit in the sixth preferred embodiment.

In detail, the tilt movement interruption device 634 includes the first circuit 256 and the second circuit 257. The ON/OFF switch 235 includes the first switch 36, the second switch 37, and the third relay 258. The first circuit 256 is a circuit connecting the positive electrode of the battery 28 and the third ground point G3. The second circuit 257 is a circuit connected in series to the power supply circuit 50. The second circuit 257 is connected to the power supply circuit 50 between the positive electrode of the battery 28 and the electric motor 27. The second circuit 257 may be connected to the power supply circuit 50 between the first ground point G1 and the electric motor 27.

The third relay 258 includes the third contact 258*a* movable between an opened position and a closed position and the third electromagnet 258*b* that moves the third contact 258*a*. The third contact 258*a* is disposed in the second circuit 257, and the third electromagnet 258*b* is disposed in the first circuit 256. In the state in which the third electromagnet 258*b* is not supplied with electric power, the third contact 258*a* is held at the opened position. When the third electromagnet 258*b* is supplied with electric power, the third contact 258*a* is held at the closed position by a magnetic force of the third electromagnet 258*b*. Therefore, when the electric power supply to the third electromagnet 258*b* is stopped, the second circuit 257 is cut off, and the power supply circuit 50 is cut off.

The first switch 36 and the second switch 37 are disposed in the first circuit 256. The first switch 36 and the second switch 37 are connected in series to the third electromagnet 258*b*. Further, the first switch 36 and the second switch 37 are connected in parallel. The tilt-up stop condition is established when the hatch 30 is closed and the outboard motor 9 is positioned between the tilt interruption position and the full tilt-up position. Specifically, the tilt-up stop condition is established when an obstacle is present in the tilt-up movement range of the outboard motor 9 and the obstacle and the outboard motor 9 are equal to or less than a predetermined distance from each other. In a state in which the hatch 30 is closed and the outboard motor 9 is at the tilt interruption position, both switches 36 and 37 are opened, and the electric power supply to the third electromagnet 258*b* is stopped. Therefore, when the tilt-up stop condition is established, the third contact 258*a* is held at the opened position, and the power supply circuit 50 is cut off. Therefore, when the tilt-up stop condition is established during the operation of the up switch 32, the power supply circuit 50 is cut off by the tilt movement interruption device 634.

When the up switch 32 is operated, an up switch operation signal is input into the remote controller ECU 461, and the remote controller ECU 461 outputs a tilt-up execution signal. The tilt-up execution signal output from the remote controller ECU 461 is transmitted to the outboard motor ECU 464 by the onboard LAN 465. When the outboard motor ECU 464 receives the tilt-up execution signal, it connects the up command transmission circuit 452 by connecting the internal circuit of the outboard motor ECU 464. Accordingly, the electric power of the battery 28 is supplied to the first electromagnet 54*b*, and in a state in which the second contact 55*a* is at a second up position (the position shown in FIG. 18), the first contact 54*a* moves from the first down position (the position shown by the alternate long and two short dashed lines) to the first up position (the position shown in FIG. 18). At this time, when the tilt-up stop condition is not established, the electric power of the battery 28 is supplied to the electric motor 27 via the first contact 54*a*, and the outboard motor 9 is tilted up. On the other hand, when the tilt-up stop condition is established, the power supply circuit 50 is cut off, so that the electric power of the battery 28 is not supplied to the electric motor 27, and the outboard motor 9 is not tilted up. Therefore, when the tilt-up stop condition is established during the operation of the up switch 32, the electric power supply to the electric motor 27 is stopped, and the tilt-up movement of the outboard motor, 9 is interrupted. Thereafter, when the tilt-up stop condition becomes canceled, the electric power is supplied again to the electric motor 27, and the tilt-up movement of the outboard motor 9 is restarted.

Seventh Preferred Embodiment

Figure 19:
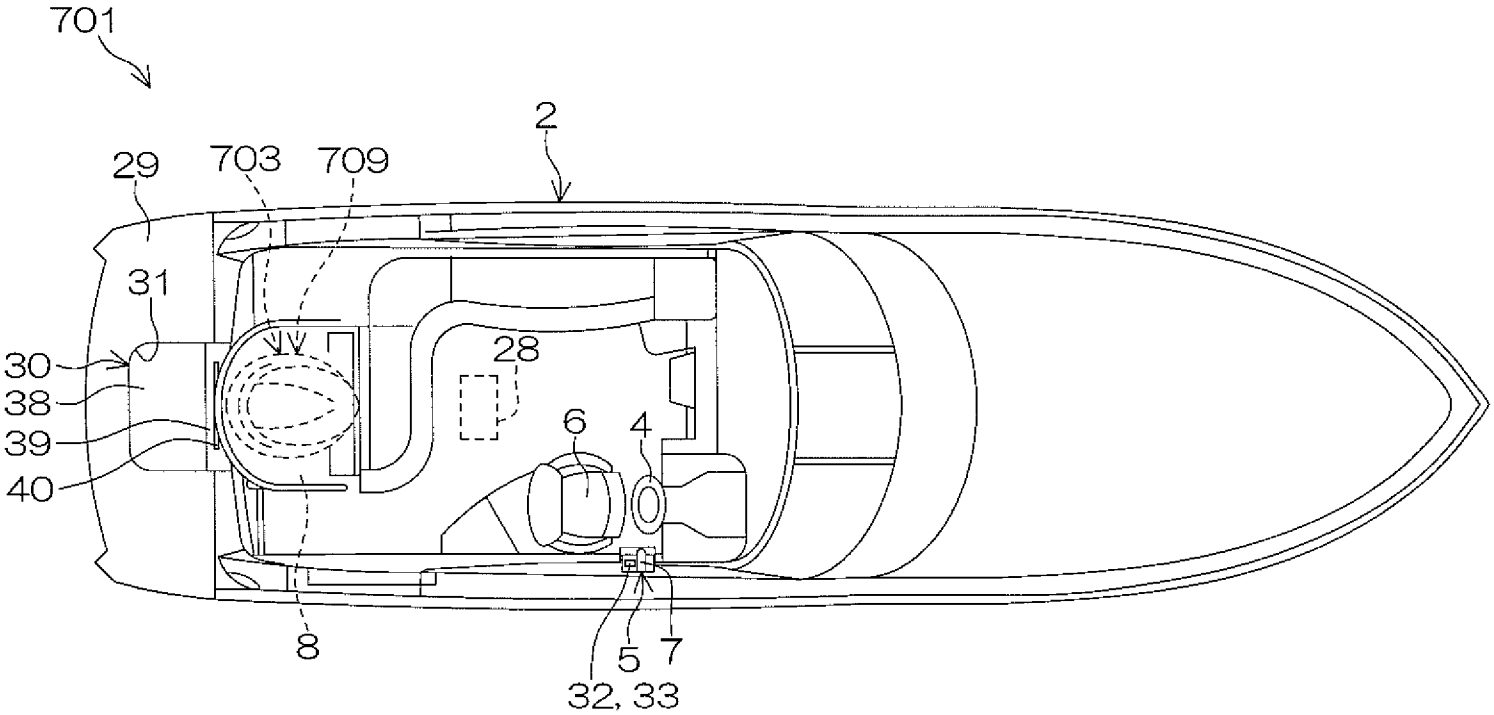
FIG. 19 is an illustrated plan view of a marine vessel according to a seventh preferred embodiment of the present invention.
Figure 20:
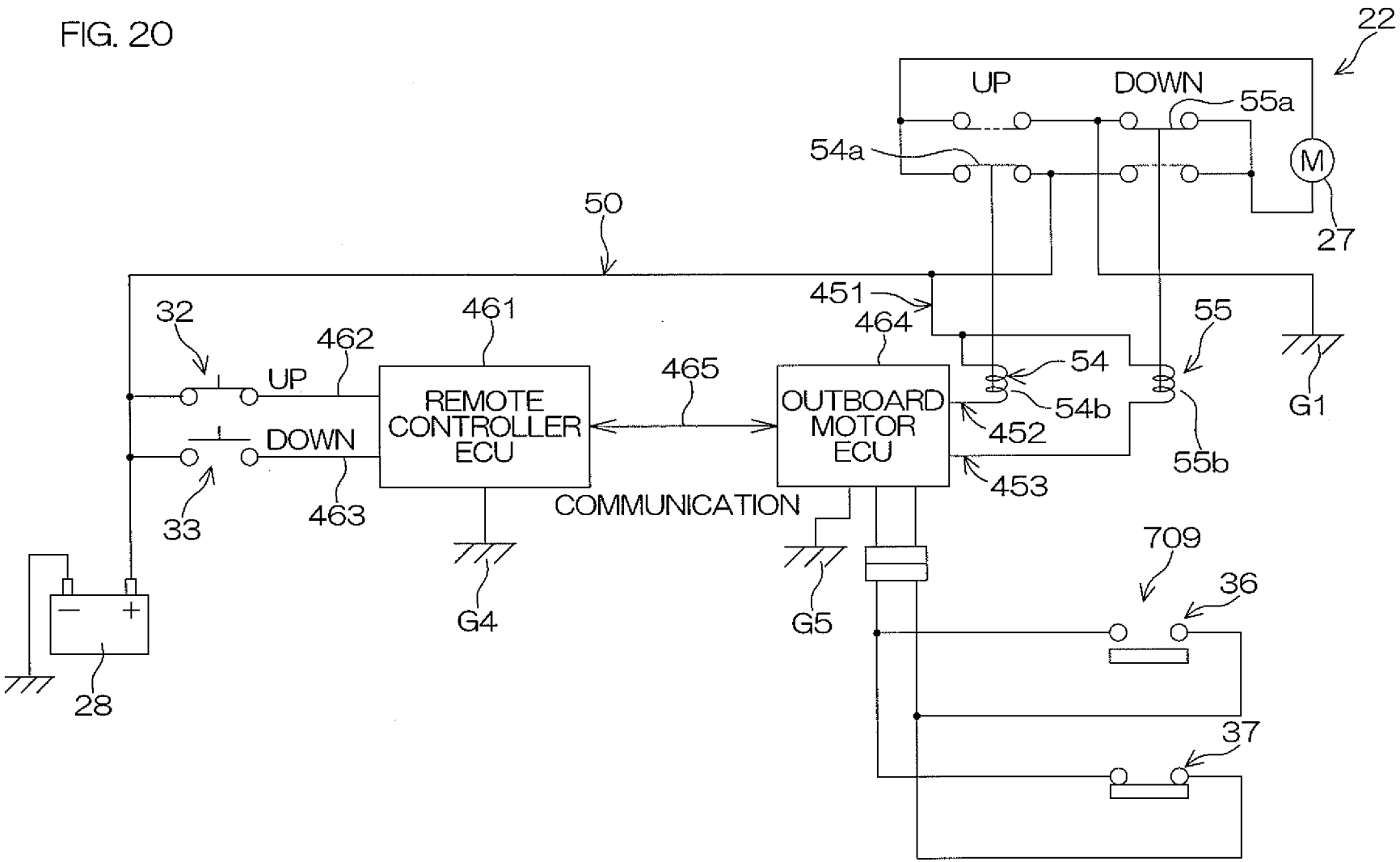
FIG. 20 is a circuit diagram of a circuit arranged to actuate the PTT device according to the seventh preferred embodiment of the present invention.
Figure 21:
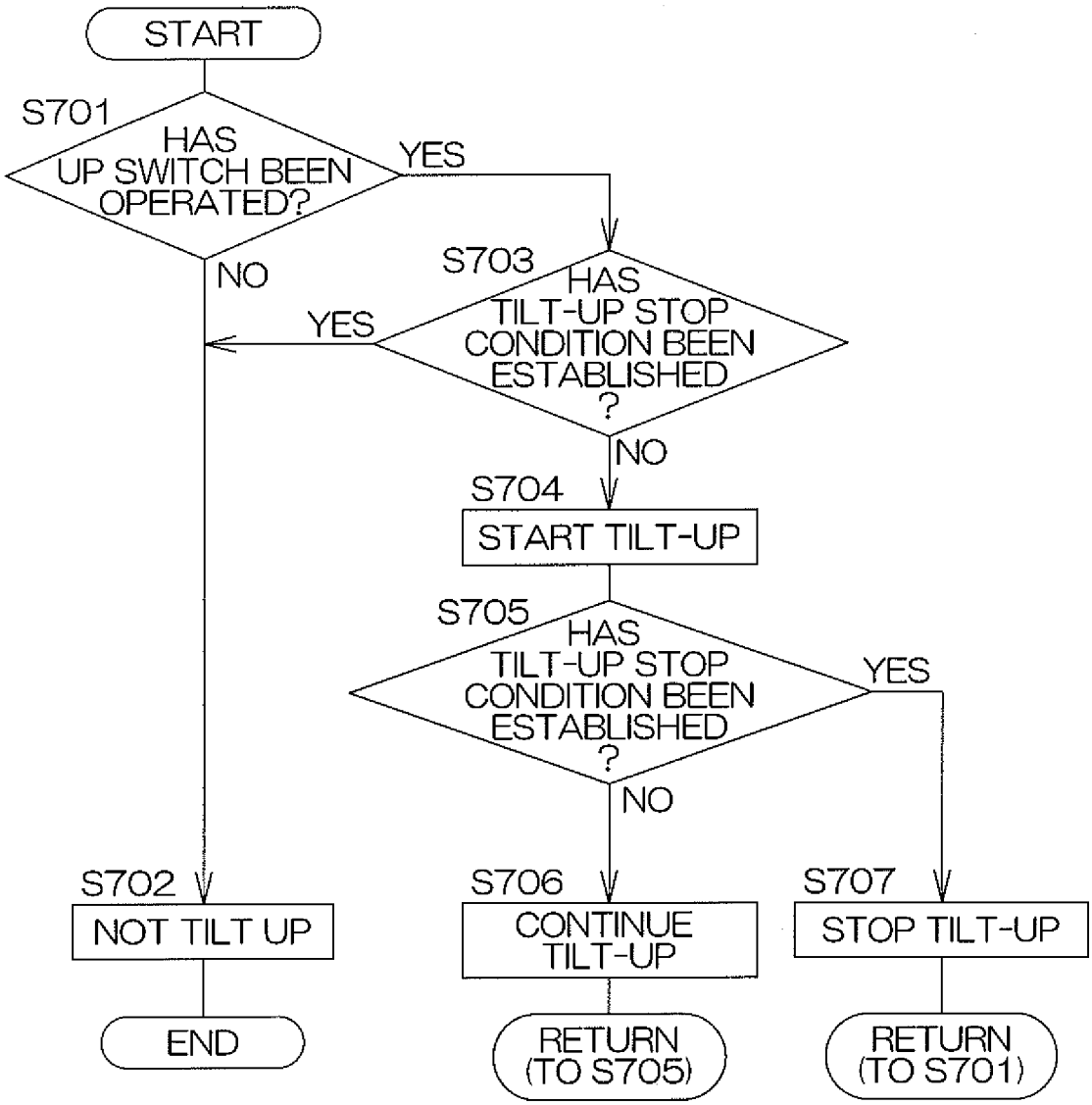
FIG. 21 is a flowchart for describing a tilt-up movement according to the seventh preferred embodiment of the present invention.

Next, a seventh preferred embodiment of the present invention will be described. A major difference between the seventh preferred embodiment and the above-described fourth preferred embodiment is that signals are input into the outboard motor ECU from the first switch and the second switch, and the outboard motor ECU stops the tilt-up movement of the outboard motor based on the signals from the first switch and the second switch. In FIG. 19 to FIG. 21 described hereinafter, components equivalent to those shown in FIG. 1 to FIG. 18 will be provided with reference numerals as in FIG. 1, etc., and description thereof will be omitted.

FIG. 19 is an illustrated plan view of amarine vessel 701 according to the seventh preferred embodiment of the present invention. FIG. 20 is a circuit diagram of a circuit arranged to actuate the PTT device 22 according to the seventh preferred embodiment of the present invention. In FIG. 19 and FIG. 20, a state in which the hatch 30 is closed and the outboard motor 709 is at a position other than a position between the tilt interruption position and the full tilt-up position is shown.

The marine vessel 701 includes a hull 2 and a marine vessel propulsion apparatus 703. The marine vessel propulsion apparatus 703 includes an outboard motor 709 and the PTT device 22. The outboard motor 709 includes the same components as those of the outboard motor 9 according to the first preferred embodiment. The outboard motor 709 includes the outboard motor ECU 464, the first switch 36, and the second switch 37 in addition to the components of the outboard motor 9 according to the first preferred embodiment. The first switch 36 detects whether or not the hatch 30 has been closed. The second switch 37 detects whether or not the outboard motor 709 is positioned between the tilt interruption position (the position shown by the dashed lines in FIG. 2) and the full tilt-up position (the position shown by the alternate long and two short dashed lines in FIG. 2). The first switch 36 and the second switch 37 are connected to the outboard motor ECU 464. The first switch 36 and the second switch 37 are connected in parallel.

The tilt-up stop condition is established when the hatch 30 is closed and the outboard motor 709 is positioned between the tilt interruption position and the full tilt-up position. Specifically, the tilt-up stop condition is established when an obstacle is present in the tilt-up movement range of the outboard motor 709 and the obstacle and the outboard motor 709 are equal to or less than a predetermined distance from each other. In the state in which the hatch 30 is closed, the first switch 36 is opened, and in the state in which the outboard motor 709 is positioned between the tilt interruption position and the full tilt-up position, the second switch 37 is opened. Therefore, when both switches 36 and 37 are opened, the tilt-up stop condition is established. On the other hand, when at least one of the first switch 36 and the second switch 37 is closed, the tilt-up stop condition is not established.

Thus, in the seventh preferred embodiment, the tilt-up stop condition is established when both switches 36 and 37 are opened. In the seventh preferred embodiment, the state in which the first switch 36 is opened is referred to as the first state, and the state in which the first switch 36 is opened is referred to as the second state. The state in which the second switch 37 is opened is referred to as the third state, and the state in which the second switch 37 is closed is referred to as the fourth state. Therefore, a condition for establishment of the tilt-up stop condition is that the first switch 36 is in the first state and the second switch 37 is in the third state. The opened/closed states of the first switch 36 and the second switch 37 are input into the outboard motor ECU 464. The outboard motor ECU 464 judges whether the tilt-up stop condition has been established based on signals input from the first switch 36 and the second switch 37, and based on the result of this judgment, outputs a tilt-up execution signal.

In detail, the outboard motor ECU 464 is programmed to output a tilt-up execution signal when the up switch 32 has been operated and the tilt-up stop condition is not established. On the other hand, the outboard motor ECU 464 is programmed not to output a tilt-up execution signal even when the up switch 32 is operated if the tilt-up stop condition has been established. The outboard motor ECU 464 is further programmed to stop the output of the tilt-up execution signal when the tilt-up stop condition is established during the operation of the up switch 32. The outboard motor ECU 464 is further programmed to restart the output of the tilt-up execution signal when the tilt-up stop condition becomes canceled after it stops the output of the tilt-up execution signal.

FIG. 21 is a flowchart for describing a tilt-up movement according to the seventh preferred embodiment of the present invention.

The outboard motor ECU 464 judges whether the up switch 32 has been operated by a marine vessel operator (S701). In detail, when the up switch 32 is operated by a marine vessel operator, a tilt-up execution signal is transmitted from the remote controller ECU 461 to the outboard motor ECU 464. Therefore, the outboard motor ECU 464 judges whether the up switch 32 has been operated by the marine vessel operator based on whether a tilt-up execution signal has been transmitted from the remote controller ECU 461. When the up switch 32 is not operated (No at S701), the outboard motor 709 is not tilted up (S702). On the other hand, when the up switch 32 is operated (Yes at S701), the outboard motor ECU 464 judges whether the tilt-up stop condition has been established (S703).

In detail, based on signals from the first switch 36 and the second switch 37, the outboard motor ECU 464 judges whether an obstacle is present in the tilt-up movement range of the outboard motor 709 and the obstacle and the outboard motor 709 are equal to or less than a predetermined distance from each other. When the tilt-up stop condition is established (Yes at S703), the outboard motor ECU 464 does not tilt up the outboard motor 709 even if the up switch 32 is operated (S702). On the other hand, when the tilt-up stop condition is not established (No at S703), the outboard motor ECU 464 tilts up the outboard motor 709 by outputting a tilt-up execution signal. Accordingly, the tilt-up movement of the outboard motor 709 is started (S704).

After the tilt-up movement is started, the outboard motor ECU 464 judges whether the tilt-up stop condition has been established during the operation of the up switch 32 (S705). When the tilt-up stop condition is not established (No at S705), the outboard motor ECU 464 continuously outputs the tilt-up execution signal and continues the tilt-up movement of the outboard motor 709 (S706). Thereafter, the outboard motor ECU 464 judges again whether the tilt-up stop condition has been established (return to S705). On the other hand, when the tilt-up stop condition is established during the operation of the up switch 32 (Yes at S705), the outboard motor ECU 464 stops the output of the tilt-up execution signal and stops tilt-up of the outboard motor 709 (S707). Accordingly, the tilt-up movement of the outboard motor 709 is interrupted.

After the tilt-up movement of the outboard motor 709 is interrupted, the outboard motor ECU 464 judges again whether the up switch 32 has been operated by the marine vessel operator (return to S701). Then, when the up switch 32 is operated (Yes at S701), the outboard motor ECU 464 judges whether the tilt-up stop condition has been established (S703). Even in the case where the tilt-up movement of the outboard motor 709 is interrupted according to establishment of the tilt-up stop condition, for example, if the hatch 30 is opened thereafter, the tilt-up stop condition is not established. Therefore, when the tilt-up stop condition is not established (No at S703), the outboard motor ECU 464 outputs a tilt-up execution signal and starts the tilt-up movement of the outboard motor 709 (S704). Accordingly, the tilt-up movement of the outboard motor 709 is restarted.

Eighth Preferred Embodiment

Figure 22:
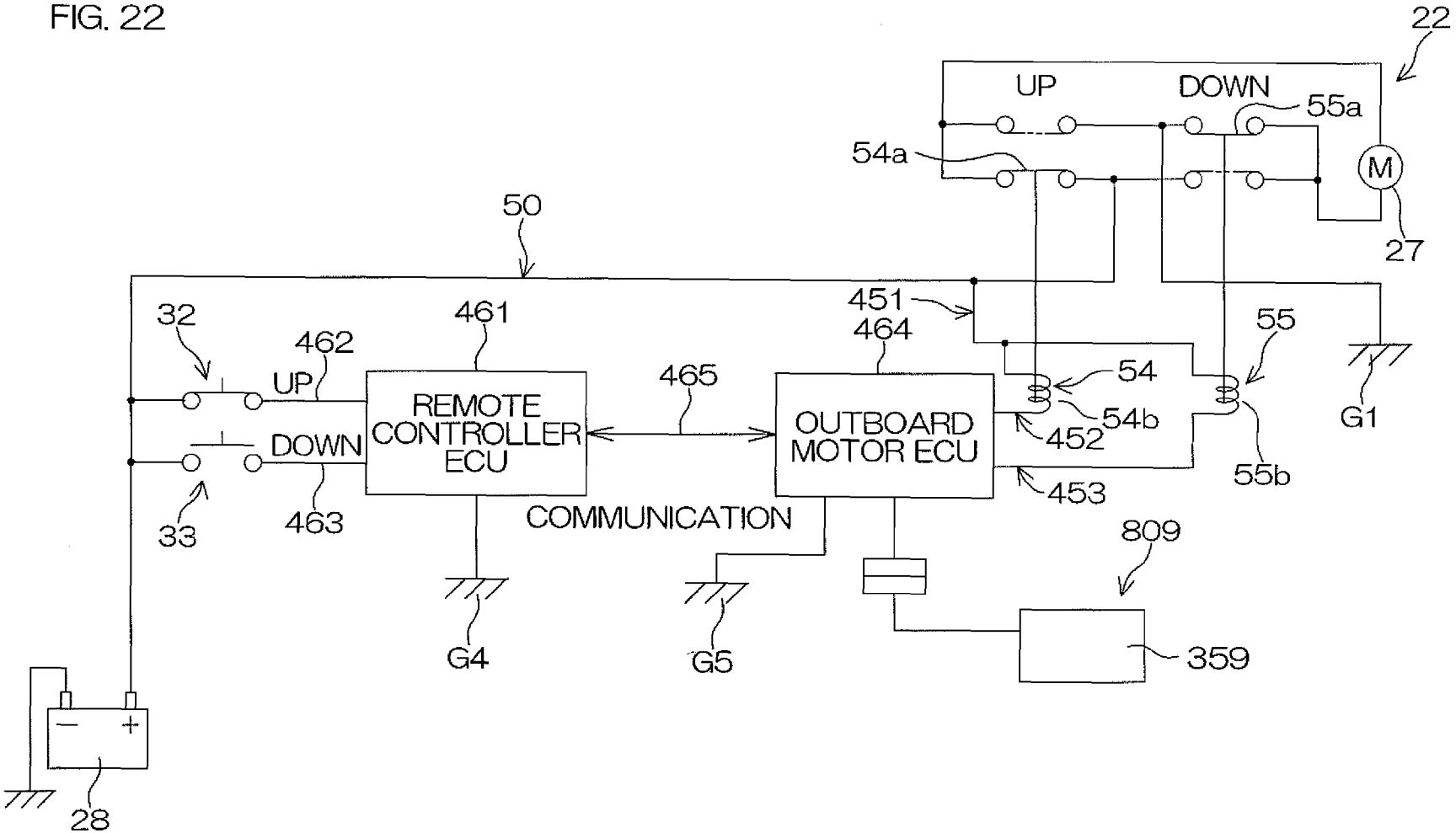
FIG. 22 is a circuit diagram of a circuit arranged to actuate the PTT device according to an eighth preferred embodiment of the present invention.

FIG. 22 is a circuit diagram of a circuit arranged to actuate the PTT device 22 according to an eighth preferred embodiment of the present invention. In this FIG. 22, components equivalent to those shown in FIG. 1 to FIG. 21 will be provided with reference numerals as those in FIG. 1, etc., and description thereof will be omitted.

A major difference between the eight preferred embodiment and the above-described seventh preferred embodiment is that the outboard motor includes a proximity sensor instead of the first switch and the second switch.

In detail, the outboard motor 809 includes the same components as those of the outboard motor 9 according to the first preferred embodiment. The outboard motor 809 includes the outboard motor ECU 464 and the proximity sensor 359 in addition to the components of the outboard motor 9 according to the first preferred embodiment. The proximity sensor 359 is connected to the outboard motor ECU 464. The proximity sensor 359 is attached to the hatch 30 (refer to FIG. 15). The proximity sensor 359 detects whether the outboard motor 809 and an obstacle are equal to or less than a predetermined distance from each other. The tilt-up stop condition is established when the outboard motor 809 and an obstacle are equal to or less than the predetermined distance from each other. For example, when the outboard motor 809 is tilted up to the tilt interruption position in the state in which the hatch 30 is closed, the outboard motor 809 and the hatch 30 become equal to or less than the predetermined distance from each other. Therefore, in this case, the proximity sensor 359 detects that the outboard motor 809 and the hatch 30 are equal to or less than the predetermined distance from each other, and outputs a signal to the outboard motor ECU 464. Therefore, the outboard motor ECU 464 can detect whether the tilt-up stop condition has been established based on a signal from the proximity sensor 359. Therefore, as in the case described with reference to the flowchart shown in FIG. 21, the outboard motor ECU 464 can control the tilt-up movement of the outboard motor 809.

Ninth Preferred Embodiment

Figure 23:
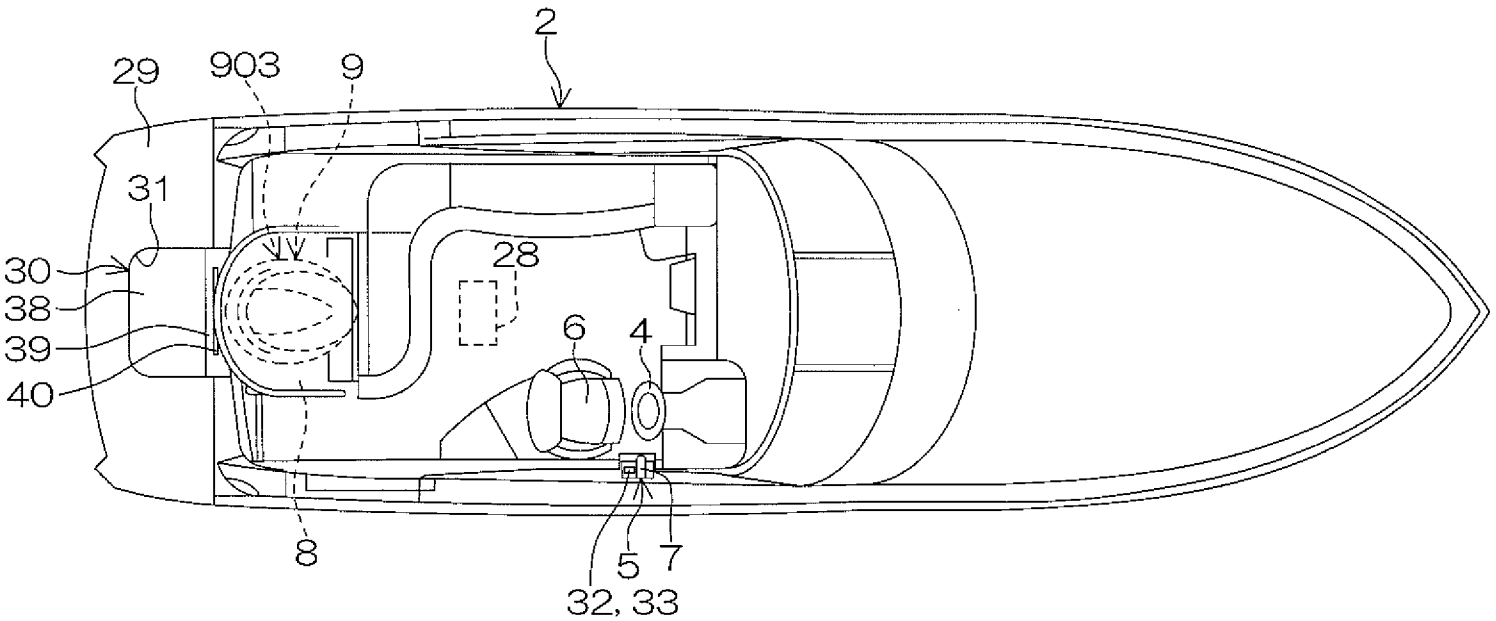
FIG. 23 is an illustrated plan view of a marine vessel according to a ninth preferred embodiment of the present invention.
Figure 24:
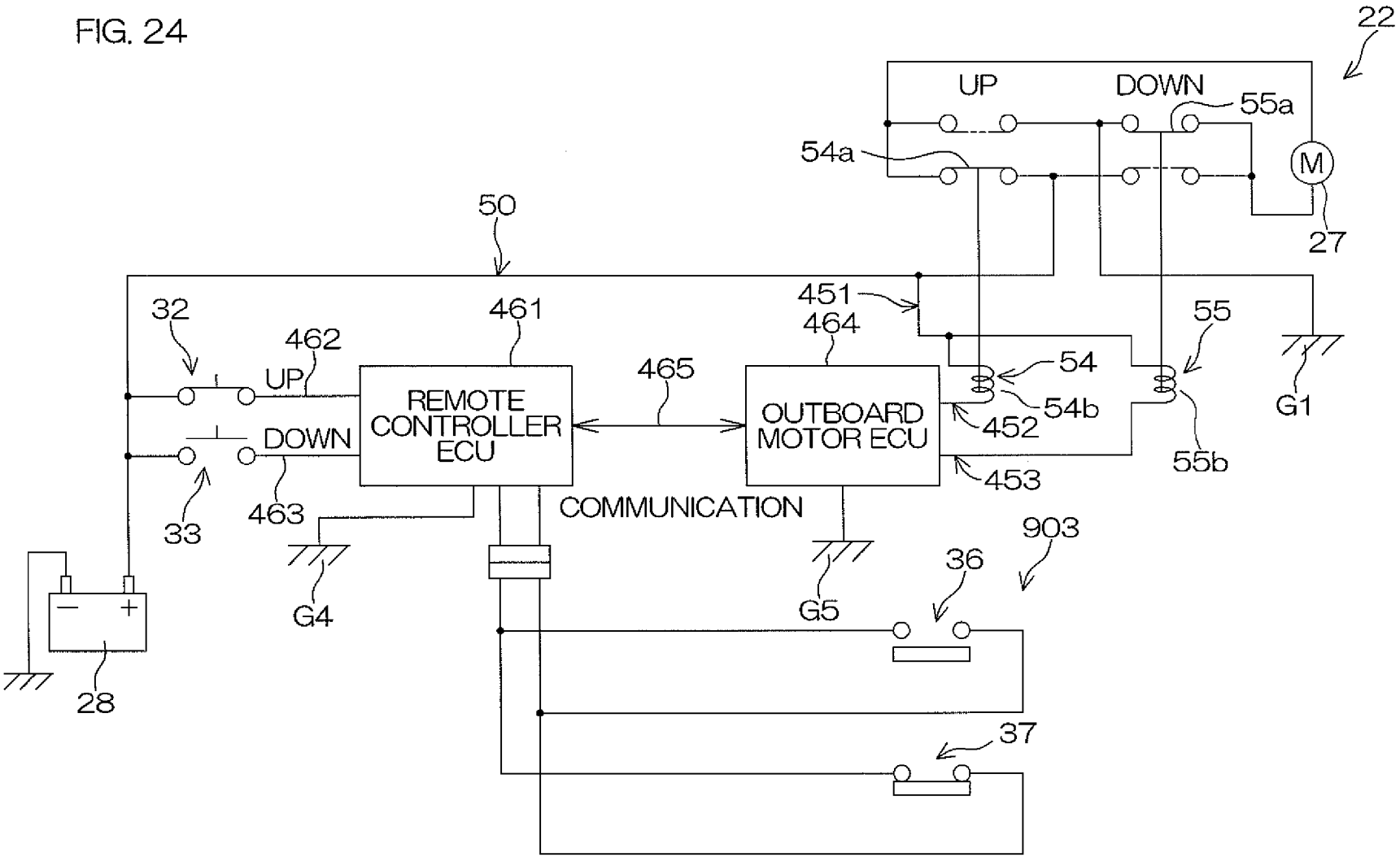
FIG. 24 is a circuit diagram of a circuit arranged to actuate the PTT device according to the ninth preferred embodiment of the present invention.
Figure 25:
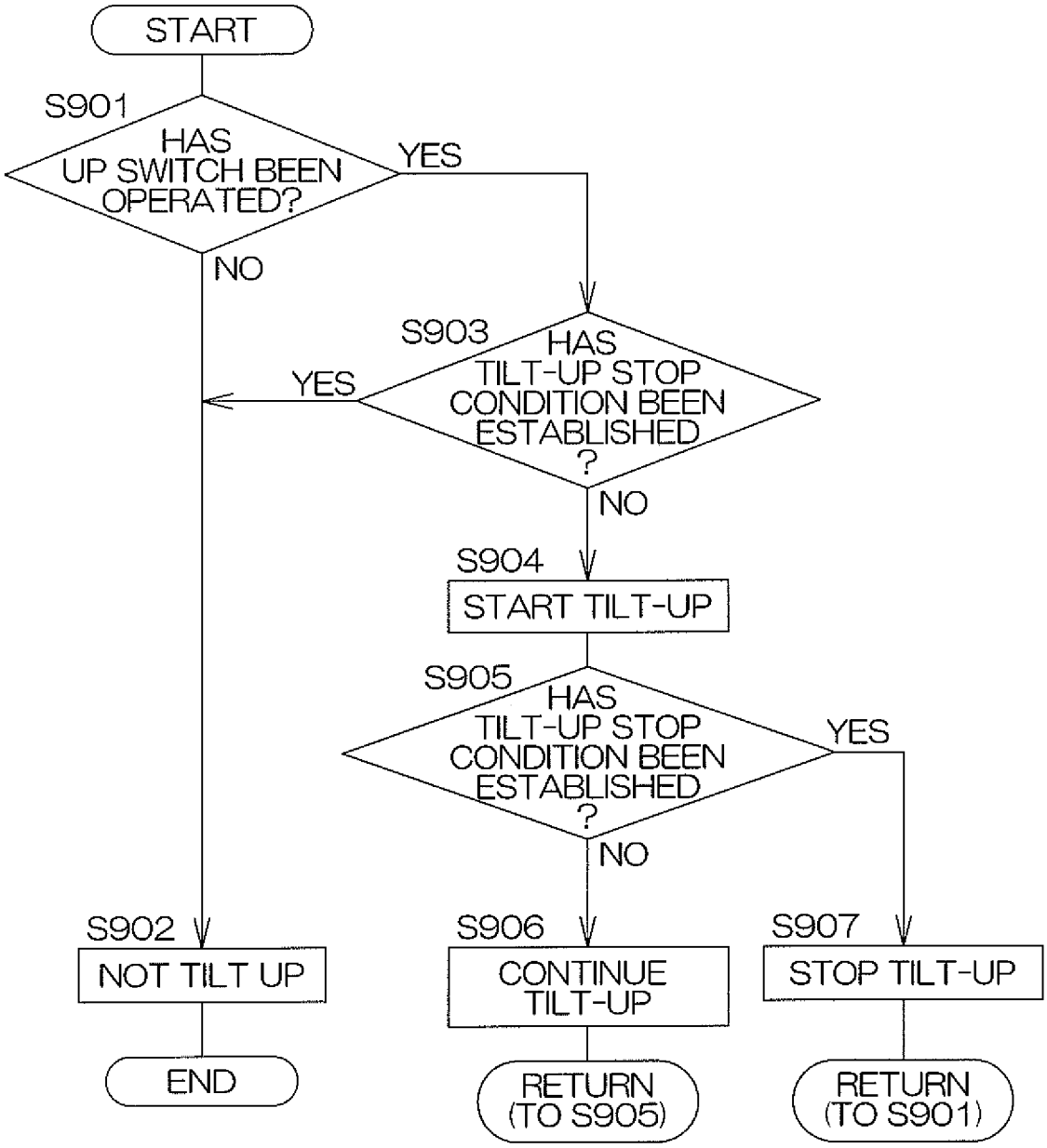
FIG. 25 is a flowchart for describing a tilt-up movement according to the ninth preferred embodiment of the present invention.

Next, a ninth preferred embodiment of the present invention will be described. A major difference between the ninth preferred embodiment and the above-described fourth preferred embodiment is that signals are input into a remote controller ECU from the first switch and the second switch, and the remote controller ECU stops the tilt-up movement of the outboard motor based on the signals from the first switch and the second switch. In FIG. 23 to FIG. 25 described below, components equivalent to those shown in FIG. 1 to FIG. 22 will be provided with reference numerals as in FIG. 1, etc., and description thereof will be omitted.

FIG. 23 is an illustrated plan view of amarine vessel 901 according to a ninth preferred embodiment of the present invention. FIG. 24 is a circuit diagram of a circuit arranged to actuate the PTT device 22 according to the ninth preferred embodiment of the present invention. In FIG. 23 and FIG. 24, a state in which the hatch 30 is closed and the outboard motor 9 is at a position other than a position between the tilt interruption position and the full tilt-up position is shown.

The marine vessel 901 includes a hull 2 and a marine vessel propulsion apparatus 903. The marine vessel propulsion apparatus 903 includes the outboard motor 9 including the PTT device 22, the up switch 32, the remote controller 5, the remote controller ECU 461, the first switch 36, and the second switch 37. The first switch 36 detects whether the hatch 30 has been closed. The second switch 37 detects whether the outboard motor 9 is positioned between the tilt interruption position and the full tilt-up position. The first switch 36 and the second switch 37 are connected to the remote controller ECU 461. The first switch 36 and the second switch 37 are connected in parallel.

The tilt-up stop condition is established when the hatch 30 is closed and the outboard motor 9 is positioned between the tilt interruption position and the full tilt-up position. Specifically, the tilt-up stop condition is established when an obstacle is present in the tilt-up movement range of the outboard motor 9 and the obstacle and the outboard motor 9 are equal to or less than a predetermined distance from each other. In the state in which the hatch 30 is closed, the first switch 36 is opened, and in the state in which the outboard motor 9 is positioned in the range between the tilt interruption position and the full tilt-up position, the second switch 37 is opened. Therefore, when both switches 36 and 37 are opened, the tilt-up stop condition is established. On the other hand, when at least one of the first switch 36 and the second switch 37 is closed, the tilt-up stop condition is not established.

Thus, in the ninth preferred embodiment, when both switches 36 and 37 are opened, the tilt-up stop condition is established. In the ninth preferred embodiment, the state in which the first switch 36 is opened is referred to as a first state, and the state in which the first switch 36 is closed is referred to as a second state. Further, the state in which the second switch 37 is opened is referred to as a third state, and the state in which the second switch 37 is closed is referred to as a fourth state. Therefore, the tilt-up stop condition is established when the first switch 36 is in the first state and the second switch 37 is in the third state. The opened/closed states of the first switch 36 and the second switch 37 are input into the remote controller ECU 461. The remote controller ECU 461 judges whether the tilt-up stop condition has been established based on signals input from the first switch 36 and the second switch 37, and based on the result of this judgment, outputs a tilt-up execution signal.

In detail, the remote controller ECU 461 is programmed to output a tilt-up execution signal to the outboard motor ECU 464 when the up switch 32 is operated and the tilt-up stop condition is not established. On the other hand, the remote controller ECU 461 is programmed not to output a tilt-up execution signal even when the up switch 32 is operated if the tilt-up stop condition is established. The remote controller ECU 461 is further programmed to stop the output of the tilt-up execution signal when the tilt-up stop condition is established during the operation of the up switch 32. Further, the remote controller ECU 461 is programmed to restart the output of the tilt-up execution signal when the tilt-up stop condition becomes canceled after it stops the output of the tilt-up execution signal.

FIG. 25 is a flowchart for describing a tilt-up movement according to the ninth preferred embodiment of the present invention.

The remote controller ECU 461 judges whether the up switch 32 has been operated by a marine vessel operator (S901). In detail, when the up switch 32 is operated by a marine vessel operator, an up switch operation signal is input into the remote controller ECU 461. Therefore, the remote controller ECU 461 judges whether the up switch 32 has been operated by a marine vessel operator based on whether an up switch operation signal has been input. When the up switch 32 is not operated (No at S901), the outboard motor 9 is not tilted up (S902). On the other hand, when the up switch 32 is operated (Yes at S901), the remote controller ECU 461 judges whether the tilt-up stop condition has been established (S903).

In detail, based on signals from the first switch 36 and the second switch 37, the remote controller ECU 461 judges whether an obstacle is present in the tilt-up movement range of the outboard motor 9 and the obstacle and the outboard motor 9 are equal to or less than a predetermined distance from each other. Then, when the tilt-up stop condition is established (Yes at S903), the remote controller ECU 461 does not tilt up the outboard motor 9 even if the up switch 32 is operated (S902). On the other hand, when the tilt-up stop condition is not established (No at S903), the remote controller ECU 461 tilts up the outboard motor 9 by outputting a tilt-up execution signal. Accordingly, the tilt-up movement of the outboard motor 9 is started (S904).

After the tilt-up movement is started, the remote controller ECU 461 judges whether the tilt-up stop condition has been established during the operation of the up switch 32 (S905). Then, when the tilt-up stop condition is not established (No at S905), the remote controller ECU 461 continuously outputs the tilt-up execution signal and continues the tilt-up movement of the outboard motor 9 (S906). Thereafter, the remote controller ECU 461 judges again whether the tilt-up stop condition has been established (return to S905). On the other hand, when the tilt-up stop condition is established during the operation of the up switch 32 (Yes at S905), the remote controller ECU 461 stops the output of the tilt-up execution signal and stops tilt-up of the outboard motor 9 (S907). Accordingly, the tilt-up movement of the outboard motor 9 is interrupted.

After the tilt-up movement of the outboard motor 9 is interrupted, the remote controller ECU 461 judges again whether the up switch 32 has been operated by a marine vessel operator (return to S901). Then, when the up switch 32 is operated (Yes at S901), the remote controller ECU 461 judges whether the tilt-up stop condition has been established (S903). Even when the tilt-up movement of the outboard motor 9 is interrupted according to establishment of the tilt-up stop condition, for example, if the hatch 30 is opened thereafter, the tilt-up stop condition is not established. Therefore, the remote controller ECU 461 starts the tilt-up movement of the outboard motor 9 by outputting a tilt-up execution signal (S904) unless the tilt-up stop condition is established (No at S903). Accordingly, the tilt-up movement of the outboard motor 9 is restarted.

Tenth Preferred Embodiment

Figure 26:
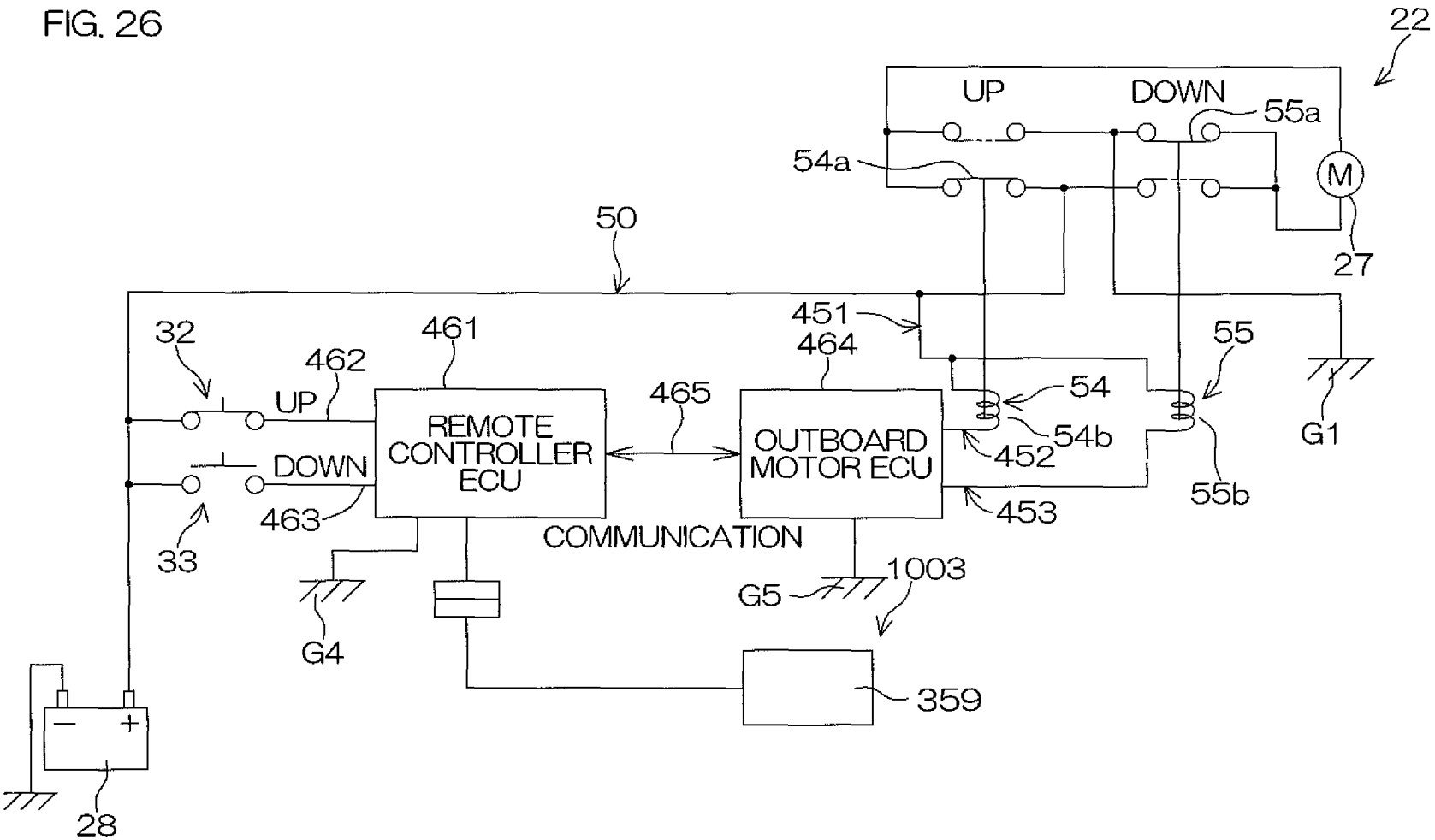
FIG. 26 is a circuit diagram of a circuit arranged to actuate the PTT device according to a tenth preferred embodiment of the present invention.

FIG. 26 is a circuit diagram of a circuit arranged to actuate the PTT device 22 according to a tenth preferred embodiment of the present invention. In FIG. 26, components equivalent to those shown in FIG. 1 to FIG. 25 will be provided with reference numerals, and description thereof will be omitted.

A major difference between the tenth preferred embodiment and the above-described ninth preferred embodiment is that the marine vessel propulsion apparatus includes a proximity sensor instead of the first switch and the second switch.

In detail, a marine vessel propulsion apparatus 1003 includes the same components as those of the marine vessel propulsion apparatus 903. The marine vessel propulsion apparatus 1003 includes the proximity sensor 359 instead of the first switch 36 and the second switch 37. The proximity sensor 359 is connected to the remote controller ECU 461. The proximity sensor 359 is attached to the hatch 30 (refer to FIG. 15). The proximity sensor 359 detects whether the outboard motor 9 and an obstacle are equal to or less than a predetermined distance from each other. For example, when the outboard motor 9 is tilted up to the tilt interruption position in the state in which the hatch 30 is closed, the outboard motor 9 and the hatch 30 become equal to or less than the predetermined distance from each other. Therefore, at this time, the proximity sensor 359 detects that the outboard motor 9 and the hatch 30 are equal to or less than the predetermined distance from each other, and outputs a signal to the remote controller ECU 461. The tilt-up stop condition is established when an obstacle is present in the tilt-up movement range and the obstacle and the outboard motor 9 are equal to or less than the predetermined distance from each other. Therefore, the remote controller ECU 461 can detect whether the tilt-up stop condition has been established based on the signal from the proximity sensor 359. Therefore, the remote controller ECU 461 can control the tilt-up movement of the outboard motor 9 in the same manner as described above with reference to the flowchart shown in FIG. 25.

Other Preferred Embodiments

Various preferred embodiments of the present invention are described above, however, the present invention is not limited to the contents of the first to tenth preferred embodiments, and can be variously changed within the scope of claims.

For example, the above-described first to tenth preferred embodiments describe a case where when the hatch 30 as an example of an obstacle enters the tilt-up movement range of the outboard motor, the tilt-up movement of the outboard motor is preferably stopped. However, it is also possible that the tilt-up movement of the outboard motor is stopped when an obstacle other than the hatch 30 enters the tilt-up movement range of the outboard motor.

The first to tenth preferred embodiments describe a case where the hatch 30 preferably is manually opened and closed. However, the hatch 30 may be automatically opened and closed. Specifically, the marine vessel may include an opening and closing mechanism that moves the hatch between an opened position and a closed position.

The first to tenth preferred embodiments describe a case where the hatch 30 is preferably attached to the platform 29 so as to turn up and down around the rear end portion of the hatch 30. However, the hatch 30 may be attached to the platform 29 so as to turn up and down around the right end portion or the left end portion of the hatch 30. Specifically, it is preferable that the hatch 30 is arranged movably between an opened position provided in the tilt-up movement range of the outboard motor and an opened position provided out of the tilt-up movement range of the outboard motor.

The first to tenth preferred embodiments describe a case of the second switch 37 preferably detects whether the outboard motor is positioned between the tilt interruption position and the full tilt-up position. However, it may be detected whether the outboard motor is positioned between the tilt interruption position and the full tilt-up position by detecting a tilting angle of the outboard motor (an angle of the outboard motor around the tilt shaft 21). Specifically, it is also possible that the marine vessel includes an angle detection device that detects a tilting angle of the outboard motor, and the value detected by the angle detection device is input into the remote controller ECU 461 or the outboard motor ECU 464.

The seventh and ninth preferred embodiments describe a case of the state in which the first switch 36 is opened is preferably referred to as a first state and the state in which the first switch 36 is closed is preferably referred to as a second state. However, it is also possible that the state in which the first switch 36 is closed is referred to as a first state and the state in which the first switch 36 is opened is referred to as a second state. Similarly, the seventh and ninth preferred embodiments describe a case of the state in which the second switch 37 is opened is preferably referred to as a third state and the state in which the second switch 37 is closed is preferably referred to as a fourth state. However, it is also possible that the state in which the second switch 37 is closed is referred to as a third state and the state in which the second switch 37 is opened is referred to as a fourth state.

Specifically, in the seventh and ninth preferred embodiments, the remote controller ECU 461 and the outboard motor ECU 464 preferably determine whether the tilt-up stop condition has been established based on signals from the first switch 36 and the second switch 37. Therefore, any combination of the first to fourth states is possible as long as the remote controller ECU 461 and the outboard motor ECU 464 can determine whether the tilt-up stop condition has been established.

The first, second, fourth to seventh, and ninth preferred embodiments describe a case where the first switch 36 and the second switch 37 preferably are limit switches. However, the first switch 36 is not limited to a limit switch but may be arranged to include a limit switch and a relay (relaying device). Similarly, the second switch 37 may be arranged to include a limit switch and a relay.

A non-limiting example of the correspondence between the components mentioned in the "SUMMARY OF THE INVENTION" and the components of the above-described preferred embodiments are as follows.

Tilt-up operation switch: up switch 32
Tilt shaft: tilt shaft 21
Outboard motor: outboard motor 9, 709, 809
Tilt device: PTT device 22
ON/OFF switch: ON/OFF switch 35, 235, 335
Outboard motor tilt movement interruption device: tilt movement interruption device 34, 234, 334, 434, 534, 634
Transmission circuit: transmission circuit 51

Power supply circuit: power supply circuit 50
First switch: first switch 36
Tilt interruption position: tilt interruption position
Tilt upper limit position: full tilt-up position
Second switch: second switch 37
Proximity sensor: proximity sensor 359
Marine vessel propulsion apparatus: marine vessel propulsion apparatus 3, 703, 903, 1003
Hull: hull 2
Marine vessel: marine vessel 1, 701, 901
First control unit: outboard motor ECU 464
Second control unit: remote controller ECU 461
Output adjusting operation unit: remote controller 5

The present application corresponds to Japanese Patent Application No. 2010-219387 filed in the Japan Patent Office on Sep. 29, 2010, and the entire disclosure of this application is incorporated herein by reference.

While preferred embodiments of the present invention have been described above, it is to be understood that variations and modifications will be apparent to those skilled in the art without departing from the scope and spirit of the present invention. The scope of the present invention, therefore, is to be determined solely by the following claims.

What is claimed is:

1. An outboard motor tilt movement interruption device arranged to interrupt a tilt-up movement of an outboard motor by interfering with an operation of a tilt device arranged to tilt up the outboard motor by turning the outboard motor around a tilt shaft in response to an operation of a tilt-up operation switch, comprising:

an ON/OFF switch disposed in a circuit arranged to actuate the tilt device, the ON/OFF switch arranged to stop tilt-up of the outboard motor by cutting off the circuit when a tilt-up stop condition including a condition that an obstacle is present in a tilt-up movement range of the outboard motor and the obstacle and the outboard motor are equal to or less than a predetermined distance from each other is established during the operation of the tilt-up operation switch, the ON/OFF switch arranged to restart tilt-up of the outboard motor by connecting the circuit when the tilt-up stop condition becomes canceled after a stop of tilt-up; wherein the ON/OFF switch includes a first switch arranged to be turned off when the obstacle is present in the tilt-up movement range of the outboard motor, the first switch arranged to be turned on when no obstacle is in the tilt-up movement range, and a second switch connected in parallel to the first switch, the second switch arranged to be turned off when a tilt position of the outboard motor is between a tilt upper limit position and a tilt interruption position set within the tilt-up movement range, the second switch arranged to be turned on when the tilt position does not reach the tilt interruption position.

2. The outboard motor tilt movement interruption device according to claim 1, wherein the ON/OFF switch is connected in series to a transmission circuit including a transmission path of a tilt-up command to be supplied to the tilt device in response to the operation of the tilt-up operation switch.

3. The outboard motor tilt movement interruption device according to claim 1, wherein the ON/OFF switch is connected in series to a power supply circuit including a power supply path of the tilt device.

4. A marine vessel propulsion apparatus comprising:

an outboard motor including a tilt device arranged to tilt up the outboard motor by turning the outboard motor around a tilt shaft;

a tilt-up operation switch arranged to be operated by an operator to actuate the tilt device to tilt up the outboard motor by turning the outboard motor around the tilt shaft; and the outboard motor tilt movement interruption device according to claim 1.

5. A marine vessel comprising:

a hull; and the marine vessel propulsion apparatus according to claim 4 provided on the hull.

6. An outboard motor comprising:

a tilt device arranged to tilt up the outboard motor by turning the outboard motor around a tilt shaft according to an operation of a tilt-up operation switch; and a control unit programmed to output a tilt-up execution signal to actuate the tilt device and tilt up the outboard motor when the tilt-up operation switch is operated and a tilt-up stop condition is not established, the control unit programmed not to output the tilt-up execution signal even when the tilt-up operation switch is operated if the tilt-up stop condition is established;

a first switch connected to the control unit, the first switch arranged to turn into a first state when an obstacle is present in a tilt-up movement range of the outboard motor, the first switch arranged to turn into a second state when no obstacle is present in the tilt-up movement range; and a second switch connected to the control unit, the second switch arranged to turn into a third state when a tilt position of the outboard motor is between a tilt upper limit position and a tilt interruption position set within the tilt-up movement range, the second switch arranged to turn into a fourth state when the tilt position does not reach the tilt interruption position; wherein the tilt-up stop condition includes a condition that the first switch is in the first state and the second switch is in the third state.

7. The outboard motor according to claim 6, wherein the outboard motor is arranged to stop tilting up when an output of the tilt-up execution signal from the control unit is stopped according to establishment of the tilt-up stop condition during the operation of the tilt-up operation switch, and the outboard motor is arranged to restart tilt-up when the tilt-up stop condition becomes canceled and the output of the tilt-up execution signal from the control unit is restarted after the stop of tilt-up.

8. The outboard motor according to claim 6, wherein the tilt-up stop condition includes a condition that an obstacle is present in a tilt-up movement range of the outboard motor and the obstacle and the outboard motor are equal to or less than a predetermined distance from each other.

9. A marine vessel propulsion apparatus comprising:

board motor according to claim 6; and a tilt-up operation switch arranged to be operated by an operator to tilt up the outboard motor by turning the outboard motor around the tilt shaft by actuating the tilt device.

10. A marine vessel comprising:

a hull; and the marine vessel propulsion apparatus according to claim 9 provided on the hull.

11. A marine vessel propulsion apparatus comprising:

an outboard motor including a tilt device arranged to tilt up the outboard motor by turning the outboard motor around a tilt shaft;

a tilt-up operation switch arranged to be operated by an operator to tilt up the outboard motor by turning the outboard motor around the tilt shaft by actuating the tilt device; and a control unit programmed to output a tilt-up execution signal to actuate the tilt device and tilt up the outboard motor when the tilt-up operation switch is operated and a tilt-up stop condition is not established, the control unit programmed not to output the tilt-up execution signal to the outboard motor even when the tilt-up operation switch is operated if the tilt-up stop condition is established; wherein the marine vessel propulsion apparatus is arranged to stop tilting-up of the outboard motor when an output of the tilt-up execution signal from the control unit is stopped according to establishment of the tilt-up stop condition during the operation of the tilt-up operation switch, and the marine vessel propulsion apparatus is arranged to restart tilt-up of the outboard motor when the tilt-up stop condition becomes canceled and the output of the tilt-up execution signal from the control unit is accordingly restarted after the stop of tilting-up.

12. The marine vessel propulsion apparatus according to claim 11, further comprising an output adjusting operation unit arranged to be operated by an operator to adjust the output of the outboard motor, wherein the control unit is installed inside the output adjusting operation unit.

13. The marine vessel propulsion apparatus according to claim 11, wherein the tilt-up stop condition includes a condition that an obstacle is present in a tilt-up movement range of the outboard motor and the obstacle and the outboard motor are equal to or less than a predetermined distance from each other.

14. The marine vessel propulsion apparatus according to claim 11, further comprising:

a first switch connected to the control unit, the first switch arranged to turn into a first state when an obstacle is present in a tilt-up movement range of the outboard motor, the first switch arranged to turn into a second state when no obstacle is present in the tilt-up movement range; and a second switch connected to the control unit, the second switch arranged to turn into a third state when a tilt position of the outboard motor is between a tilt upper limit position and a tilt interruption position set within the tilt-up movement range, the second switch arranged to turn into a fourth state when the tilt position does not reach the tilt interruption position, wherein the tilt-up stop condition includes a condition that the first switch is in the first state and the second switch is in the third state.

15. The marine vessel propulsion apparatus according to claim 11, further comprising:

a proximity sensor connected to the control unit, the proximity sensor arranged to detect whether the outboard motor and an obstacle are equal to or less than a predetermined distance from each other, wherein the tilt-up stop condition includes a condition that the proximity sensor has detected that the outboard motor and the obstacle are equal to or less than the predetermined distance from each other.

16. A marine vessel comprising:

a hull; and the marine vessel propulsion apparatus according to claim 11 provided on the hull.

* * * * *

UNITED STATES PATENT AND TRADEMARK OFFICE

CERTIFICATE OF CORRECTION

PATENT NO. : 8,795,012 B2
APPLICATION NO. : 13/238099
DATED : August 5, 2014
INVENTOR(S) : Morihiro Ooishi et al.

It is certified that error appears in the above-identified patent and that said Letters Patent is hereby corrected as shown below:

In the Claims

In Claim 6, line 15 of column 30, "and" should be deleted.

In Claim 9, line 55 of column 30, "board" should read "the outboard".

Signed and Sealed this
Eleventh Day of November, 2014

Michelle K. Lee

Michelle K. Lee
*Deputy Director of the United States Patent and Trademark Office*